US011053627B2

(12) United States Patent
Kim et al.

(10) Patent No.: US 11,053,627 B2
(45) Date of Patent: Jul. 6, 2021

(54) AUTOMATIC DETERGENT SUPPLY APPARATUS AND WASHING MACHINE HAVING THE SAME

(71) Applicant: SAMSUNG ELECTRONICS CO., LTD., Suwon-si (KR)

(72) Inventors: Yong Kwon Kim, Suwon-si (KR); Kyung Mok Yoo, Gumi-si (KR); Seon Ju Lee, Seoul (KR); Chui Yong Cho, Seoul (KR); Jong Su Jeon, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/848,431

(22) Filed: Apr. 14, 2020

(65) Prior Publication Data

US 2020/0256002 A1 Aug. 13, 2020

Related U.S. Application Data

(63) Continuation of application No. 15/369,018, filed on Dec. 5, 2016, now Pat. No. 10,711,385, which is a (Continued)

(30) Foreign Application Priority Data

Jul. 3, 2013 (KR) ..... 10-2013-0077669
Feb. 11, 2014 (KR) ..... 10-2014-0015709
Jun. 27, 2014 (KR) ..... 10-2014-0079825

(51) Int. Cl.
*D06F 39/02* (2006.01)
*D06F 37/04* (2006.01)

(52) U.S. Cl.
CPC ..... *D06F 39/022* (2013.01); *D06F 37/04* (2013.01); *D06F 39/02* (2013.01)

(58) Field of Classification Search
CPC ..... D06F 39/02; D06F 39/022; D06F 37/04
(Continued)

(56) References Cited

U.S. PATENT DOCUMENTS 3,022,656 A 2/1962 Bergeson et al.
4,700,554 A 10/1987 Eichman et al.
(Continued)

FOREIGN PATENT DOCUMENTS

CN 101054767 A 10/2007
CN 101204315 6/2008
(Continued)

OTHER PUBLICATIONS

KR101992137B1—Machine translation (Year: 2012).*
(Continued)

*Primary Examiner* — Tinsae B Ayalew
(74) *Attorney, Agent, or Firm* — Staas & Halsey LLP

(57) ABSTRACT

Disclosed herein is a washing machine that includes a tub disposed in a main body of the washing machine to store water. A circulation apparatus includes a circulation pump operable to circulate the water in and out of the tub. A detergent supply apparatus is coupled to the circulation apparatus to discharge detergent to the circulation apparatus so that operation of the circulation pump causes the discharged detergent to be supplied to the tub.

25 Claims, 23 Drawing Sheets

Related U.S. Application Data continuation of application No. 14/902,844, filed as application No. PCT/KR2014/005765 on Jun. 27, 2014, now Pat. No. 10,815,604.

(58) Field of Classification Search
USPC ..... 68/17 R
See application file for complete search history.

(56) References Cited

U.S. PATENT DOCUMENTS

| | | | | |
|---|---|---|---|---|
| 5,396,914 | A | 3/1995 | McNair | |
| 5,548,978 | A | 8/1996 | Bongini et al. | |
| 5,934,109 | A | 8/1999 | Kiefer et al. | |
| 2008/0256723 | A1 | 10/2008 | Kim et al. | |
| 2009/0229312 | A1 | 9/2009 | Chung et al. | |
| 2009/0288452 | A1 | 11/2009 | Lee et al. | |
| 2010/0018258 | A1 | 1/2010 | Cho et al. | |
| 2010/0088828 | A1 | 4/2010 | Kim et al. | |
| 2010/0107704 | A1 | 5/2010 | Seo et al. | |
| 2010/0115709 | A1 | 5/2010 | Kim et al. | |
| 2010/0139328 | A1 | 6/2010 | Favaro | |
| 2011/0154865 | A1 | 6/2011 | Lee et al. | |
| 2012/0096901 | A1 * | 4/2012 | Zattin | D06F 39/02 68/13 R |
| 2012/0103028 | A1 | 5/2012 | Lee et al. | |
| 2012/0180533 | A1 | 7/2012 | Song et al. | |

FOREIGN PATENT DOCUMENTS

| | | | | |
|---|---|---|---|---|
| CN | 101696544 | | 4/2010 | |
| CN | 201732025 | | 2/2011 | |
| EP | 0406115 | A1 | 6/1990 | |
| EP | 0655522 | A1 | 11/1994 | |
| EP | 1445368 | A2 | 8/2004 | |
| EP | 1445368 | A3 | 11/2005 | |
| EP | 1884584 | A2 | 2/2008 | |
| EP | 2 011 913 | A1 | 1/2009 | |
| EP | 2 405 052 | A1 | 1/2012 | |
| EP | 2602378 | A1 | 6/2013 | |
| JP | 63-257596 | | 10/1988 | |
| KR | 10-2008-0026808 | | 3/2008 | |
| KR | 10-2008-0089086 | | 10/2008 | |
| KR | 10-2010-0048343 | | 5/2010 | |
| KR | 10-2015-0044427 | | 5/2010 | |
| KR | 10-2012-0044427 | | 5/2012 | |
| KR | 10-2012-0053579 | | 5/2012 | |
| KR | 10-2012-0082989 | | 7/2012 | |
| KR | 10-2013-0063858 | | 6/2013 | |
| KR | 101992137 | B1 * | 6/2019 | D06F 39/02 |

OTHER PUBLICATIONS

U.S. Office Action dated Feb. 24, 2020 from corresponding U.S. Appl. No. 14/902,844.
U.S. Office Action dated Sep. 30, 2019 from corresponding U.S. Appl. No. 14/902,844.
European Office Action dated Sep. 6, 2019 from European Patent Application No. 17180009.7, 12 pages.
U.S. Office Action dated May 2, 2019 from copending U.S. Appl. No. 14/902,844.
Indian Office Action dated Feb. 27, 2019 from Indian Patent Application No. 201617003118, 6 pages.
Chinese Office Action dated Mar. 4, 2019 from Chinese Patent Application No. 201710565251.8, 16 pages.
European Office Action dated Sep. 13, 2018 from European Patent Application No. 14819291.7, 7 pages.
Australian Office Action dated Oct. 5, 2018 from Australian Patent Application No. 2016269472, 3 pages.
Australian Office Action dated Feb. 21, 2019 in corresponding Australian Patent Application No. 2016269472 (3 pages).
Korean Office Action dated Dec. 24, 2018 in corresponding Korean Patent Application No. 10-2017-0047209 (2 pages).
Korean Office Action dated Dec. 24, 2018 in corresponding Korean Patent Application No. 10-2018-0032807 (2 pages).
Korean Patent Office Action issued in Korean Patent Application No. 10-2017-0047209 dated Jul. 30, 2018 (8 total pages).
Korean Patent Office Action issued in Korean Patent Application No. 10-2018-0032807 dated Jun. 20, 2018 (13 total pages).
Office Action issued Oct. 29, 2018 in co-pending U.S. Appl. No. 14/902,844 (27 pages).
First Office Action dated Jul. 5, 2018 in co-pending U.S. Appl. No. 14/902,844 (31 pages).
Chinese Office Action dated Dec. 12, 2016 in related Chinese Patent Application No. 201480038108.8 (1 page) (1 page English Translation).
Extended European Search Report dated Feb. 14, 2017 in related European Patent Application No. 14819291.7 (10 pages).
International Search Report of PCT Patent Application No. PCT/KR2014/005765 dated Oct. 6, 2014.
Notice of Acceptance dated Sep. 22, 2016 in related Australian Patent Application No. 2014284901 (2 pages).
First Chinese Office Action dated Jul. 4, 2017 in related Chinese Patent Application No. 201480038108.8 (5 pages) (4 pages English Translation).
Non-final Office Action dated Jan. 12, 2018 in co-pending U.S. Appl. No. 14/902,844 (25 pages).
Extended European Search Report dated Nov. 24, 2017, in corresponding European Patent Application No. 17180009.7, 12 pgs.
Chinese Notice of Allowance dated Feb. 6, 2018, in corresponding Chinese Patent Application No. 201480038108.8, 4 pgs.
Korean Office Action dated Jan. 21, 2018, in corresponding Korean Patent Application No. 10-2017-0047209, 5pgs.
European Office Action dated Feb. 13, 2018, in corresponding European Patent Application No. 14 819 291.7, 5 pgs.
U.S. Office Action dated Jul. 11, 2018 in U.S. Appl. No. 15/369,018.
U.S. Office Action dated Dec. 3, 2018 in U.S. Appl. No. 15/369,018.
U.S. Advisory Action dated Feb. 8, 2019 in U.S. Appl. No. 15/369,018.
U.S. Office Action dated Mar. 28, 2019 in U.S. Appl. No. 15/369,018.
U.S. Office Action dated Aug. 5, 2019 in U.S. Appl. No. 15/369,018.
U.S. Advisory Action dated Nov. 7, 2019 in U.S. Appl. No. 15/369,018.
U.S. Notice of Allowance dated Dec. 12, 2019 in U.S. Appl. No. 15/369,018.
U.S. Advisory Action dated Aug. 2, 2019 from corresponding U.S. Appl. No. 14/902,844.
U.S. Advisory Action dated Sep. 14, 2018 from corresponding U.S. Appl. No. 14/902,844.
U.S. Appl. No. 15/369,018, filed Dec. 5, 2018, Yong Kwon Kim, Samsung Electronics Co., Ltd.
U.S. Appl. No. 14/902,844, filed Jan. 4, 2016, Yong Kwon Kim, Samsung Electronics Co., Ltd.
U.S. Appl. No. 16/843,509, filed Apr. 8, 2020, Yong Kwon Kim, Samsung Electronics Co., Ltd.
U.S. Notice of Allowance dated Sep. 22, 2020 from U.S. Appl. No. 14/902,844.
U.S. Advisory Action dated Apr. 28, 2020 from U.S. Appl. No. 14/902,844.
Korean Office Action dated Aug. 18, 2020 from Korean Application No. 10-2014-0079825, 5 pages.
European Office Action dated Jul. 22, 2020 from European Application No. 14819291.7, 3 pages.
European Office Action dated Aug. 13, 2020 from European Application No. 17180009.7, 74 pages.

* cited by examiner

AUTOMATIC DETERGENT SUPPLY APPARATUS AND WASHING MACHINE HAVING THE SAME

CROSS-REFERENCE TO RELATED APPLICATIONS

[1] This application is a Continuation application of U.S. application Ser. No. 15/369,018, filed Dec. 5, 2016, which is a Continuation application of U.S. application Ser. No. 14/902,844, filed Jan. 4, 2016, and is based upon a 35 USC 371 of International Patent Application No. PCT/KR2014/005765, filed Jun. 27, 2014, which claims priority to Korean Patent Application No. 10-2013-0077669, filed Jul. 3, 2013; Korean Patent Application No. 10-2014-0015709, filed Feb. 11, 2014; and Korean Patent Application No. 10-2014-0079825, Jun. 27, 2014, the entire contents of all of which are incorporated herein by reference.

BACKGROUND

The present disclosure relates to a detergent supply apparatus disposed on a bottom inside a body and a washing machine having the same.

Generally, washing machines are apparatuses which wash laundry by rotating a rotating tub having a cylindrical shape filled with the laundry and washing water. In types of such washing machines, there are drum type washing machines in which a rotating tub is horizontally disposed to allow laundry to be lifted upward and dropped along an inner circumference of the rotating tub while the rotating tub rotates in forward and backward directions with respect to a horizontal axis to wash the laundry and vertical-axial type washing machines in which a rotating tub including a pulsator therein is vertically disposed to wash laundry using water currents generated by the pulsator while the rotating tub rotates in forward and backward directions with respect to a vertical axis.

A drum type washing machine includes a housing which forms an external shape, a cylindrical-shaped water tub installed in the housing and filled with washing water, a rotating tub rotatably installed in the water tub to wash laundry, a driving motor disposed in the rear of the water tub to rotate the rotating tub, and a door installed in front of the housing.

A detergent supply apparatus which is configured to allow a detergent to be evenly mixed with supplied water to be supplied together during a process of supplying the water into the water tub is installed above the drum type washing machine.

The detergent supply apparatus is built in a front portion of a top of the body of the drum type washing machine and includes a box-shaped case with an open front and a drawer-shaped detergent box mounted to be inserted into the case through the open front of the case.

Since the detergent box has a plurality of detergent insertion spaces divided therein to allow a user to insert a detergent according to types thereof, it is necessary to insert the detergent necessary for washing to wash for every washing, thereby deteriorating usability.

Also, such detergent supply type has a structure to allow the detergent box to be withdrawn forward from the top of the body, is not easy to operate an operation panel located on the top of body, and has a poor external shape.

SUMMARY

It is an aspect of the present disclosure to provide a washing machine in which a detergent supply apparatus is located on a bottom inside a body to automatically supply a liquid detergent and a fabric softener.

It is another aspect of the present disclosure to provide a washing machine in which a detergent supply apparatus is located on a bottom inside a body to improve an external shape.

It is still another aspect of the present disclosure to provide an automatic detergent supply apparatus with a massive storage of a liquid detergent to increase usability and a washing machine including the same.

It is yet another aspect of the present disclosure to provide a detergent supply apparatus capable of allowing a detergent box thereof to be withdrawn using one touch to increase usability of a product and a washing machine including the same.

In accordance with one aspect of the present disclosure, a washing machine includes a body with an opening portion formed in a front side thereof, a door provided to open and close the opening portion of the body, a door guide provided on the opening portion, and a detergent supply apparatus which includes a detergent box provided on a bottom of the door guide to be withdrawable toward a center of the opening portion and a detergent supply pump provided to discharge a detergent in the detergent box.

The door guide may include an incision portion formed by cutting at least a part thereof.

The door guide may be integrally formed to extend along a circumference of the opening portion.

The incision portion may include an opening formed in the door guide and a detergent box cover mounting portion connected to the opening and formed to correspond to the detergent box cover.

The incision portion may be disposed at a bottom of the door guide.

The incision portion may be disposed on one side of a circumferential surface of the door guide along a circumferential direction thereof.

The detergent supply apparatus may include a housing disposed at a bottom inside the body and the detergent box detachably provided in the housing to store the detergent therein.

The detergent box may include a detergent box body provided with a first accommodating portion configured to store a first detergent therein and a second accommodating portion configured to store a second detergent therein and a detergent box cover coupled with a top end of the detergent box body to be slidable.

The detergent box cover may move in front of the body and functions as a handle.

The detergent box cover may be formed of the same material as the door guide.

The detergent box cover may be located on the same plane as the door guide.

The detergent box cover may be provided to be slidable in a circumferential direction of the door guide.

The detergent box cover may include a magnet provided to be detachably coupled with the detergent box body.

The washing machine may include a front frame disposed to be separate from the front side to support the door guide. Here, the front frame may include a pump installation opening formed by cutting at least a part of a bottom thereof to install the detergent supply apparatus.

The detergent box may be provided to be inserted or withdrawn in a vertical direction of the housing. The washing machine may further include a mounting sensor which senses mounting of the detergent box.

The detergent box body may include a detergent supply portion provided to supply the first and second detergents to the first accommodating portion and the second accommodating portion, respectively, a detergent ejection portion provided to allow the first and second detergents to be ejected from the first accommodating portion and the second accommodating portion, and an air through-hole formed to penetrate the first accommodating portion and the second accommodating portion and provided to uniformly maintain an internal pressure.

The detergent ejection portion may include a valve provided between the accommodating portion and the housing to control an ejection amount of the detergent.

The housing may include a first reservoir provided to be connectable with the first accommodating portion and a second reservoir provided to be connectable with the second accommodating portion.

The detergent supply pump may include first and second chambers connected to the first and second reservoirs, respectively, a piston member provided to apply pressure to the first and second chambers, a motor provided to drive the piston member, and gear member which connects the motor with the piston member.

The gear member may include a worm shaft which is connected to the motor and rotates, a worm gear which is engaged with the worm shaft and rotates, and a cam member which is connected to the worm gear and moves the piston member.

The detergent supply pump may be provided with a first outlet and a second outlet connected to the first and second chambers and provided to discharge the first and second detergents.

The detergent supply pump may further include a sensor for measuring whether the detergents are present in the first and second chambers.

The body may include a tub which stores washing water therein, a drainage apparatus configured to forcibly discharge the washing water of the tub outward, and a circulating pump provided in the drainage apparatus to circulate the washing water of the tub. Here, the detergent supply apparatus may include a first connection pipe which connects the tub with the drainage apparatus and a second connection pipe which connects the tub with the circulating pump, and the first outlet and the second outlet may be connected to the first connection pipe.

The detergent box may include a popup unit to be able to pop up or pass through from the incision portion.

The popup unit may include a popup supporting groove formed on a bottom surface of the detergent box and a popup member elastically deformed to be coupled with the popup supporting groove.

The popup member may include a first popup portion coupled with a bottom surface of the body, a second popup portion provided to be movable from an inside to an outside of the first popup portion, and a popup spring which elastically supports a space between the first popup portion and the second popup portion.

The popup unit may further include a latch unit which locks or unlocks the detergent box.

In accordance with another aspect of the present disclosure, a washing machine includes a body with an opening portion formed in a front side thereof, a door provided to open and close the opening portion, a door guide provided on the opening portion, and a detergent box separably provided through an incision portion formed by cutting at least a part of the door guide.

The detergent box may be provided to be withdrawable toward a center of the opening portion.

The incision portion may be disposed at a bottom of the door guide.

The door guide may be integrally formed to extend toward the rear of the opening portion.

The detergent box may include a popup unit to be able to pop up or pass through from the incision portion.

The detergent box may include a detergent box body provided with at least one of a first accommodating portion configured to store a first detergent therein and a second accommodating portion configured to store a second detergent therein and a detergent box cover coupled with a top end of the detergent box body to be slidable.

The detergent box cover may include a magnet provided to be detachably coupled with the detergent box body.

The detergent box cover may be formed of the same material as the door guide.

The detergent box cover may be located on the same plane as the door guide.

The detergent box body may include a detergent supply portion provided to supply one of the first and second detergents to the accommodating portion, a detergent ejection portion provided to allow the detergent to be ejected from the accommodating portion, and an air through-hole formed to penetrate the accommodating portion and provided to uniformly maintain an internal pressure.

The detergent ejection portion may include a valve provided between the accommodating portion and the housing to control an ejection amount of the detergent.

The washing machine may further include a detergent supply pump provided to discharge the detergent in the detergent box.

The washing machine may include a pump connecting member provided to connect the detergent box with the detergent supply pump.

The detergent supply pump may include at least one chamber connected to the detergent ejection portion, a piston member provided to apply a pressure to the at least one chamber, a motor provided to drive the piston member, and a gear member which connects the motor with the piston member.

The gear member may include a worm shaft which is connected to the motor and rotates, a worm gear which is engaged with the worm shaft and rotates, and a cam member which is connected to the worm gear and moves the piston member.

The detergent supply pump may be provided with at least one outlet connected to the at least one chamber and provided to discharge one of the first and second detergents.

The detergent supply pump may further include a sensor for measuring whether there is the detergent accommodated in the at least one chamber.

In accordance with still another aspect of the present disclosure, a washing machine includes a body with an opening portion formed in a front side thereof, a door provided to open and close the opening portion of the body, and a door guide provided on the opening portion. Here, the door guide includes an incision portion formed by cutting at least a part thereof, the washing machine includes a detergent box provided to pop up or pass through from the incision portion, and a detergent box cover which covers a top end of the detergent box is provided to correspond to the incision portion and the detergent box is withdrawable through the incision portion.

The incision portion may be provided at a bottom of the door guide.

The incision portion may be disposed on one side of a circumferential surface of the door guide along a circumferential direction thereof.

The detergent box cover may include a magnet provided to be detachably coupled with the detergent box.

The detergent box may include a detergent box body provided with at least one of a first accommodating portion configured to store a first detergent therein and a second accommodating portion configured to store a second detergent therein.

The washing machine may further include a detergent supply pump provided to discharge the detergent in the accommodating portion.

According to embodiments of the present disclosure, a detergent supply apparatus is located on a bottom inside a body, thereby improving an external shape.

Also, a detergent supply apparatus which stores a large amount of a liquid detergent and a fabric softener is located on a bottom inside a body to automatically supply them, thereby increasing usability.

Also, a detergent box of a detergent supply apparatus is withdrawn using one touch, thereby increasing usability of a product.

DETAIL DESCRIPTION

Figure 1:
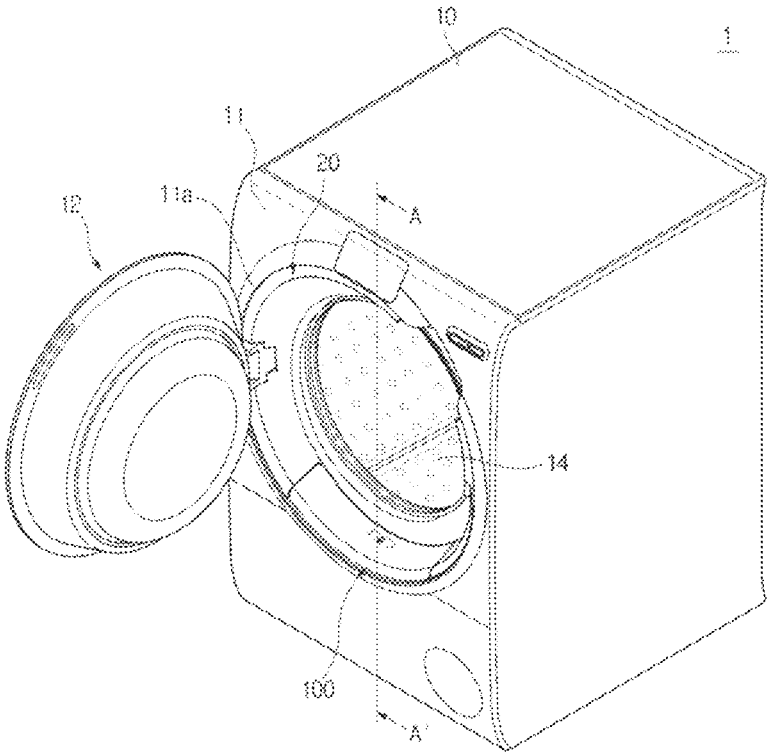
FIG. 1 is a perspective view of a drum type washing machine in accordance with one embodiment of the present disclosure.
Figure 2:
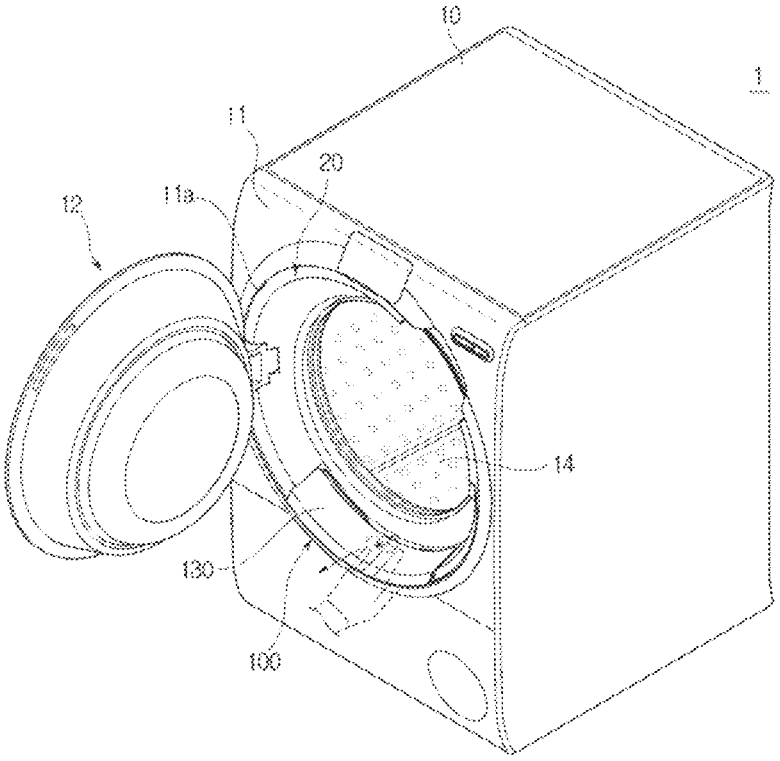
FIGS. 2 and 3 are perspective views of the drum type washing machine mounted with a detergent supply apparatus in accordance with one embodiment of the present disclosure.
Figure 3:
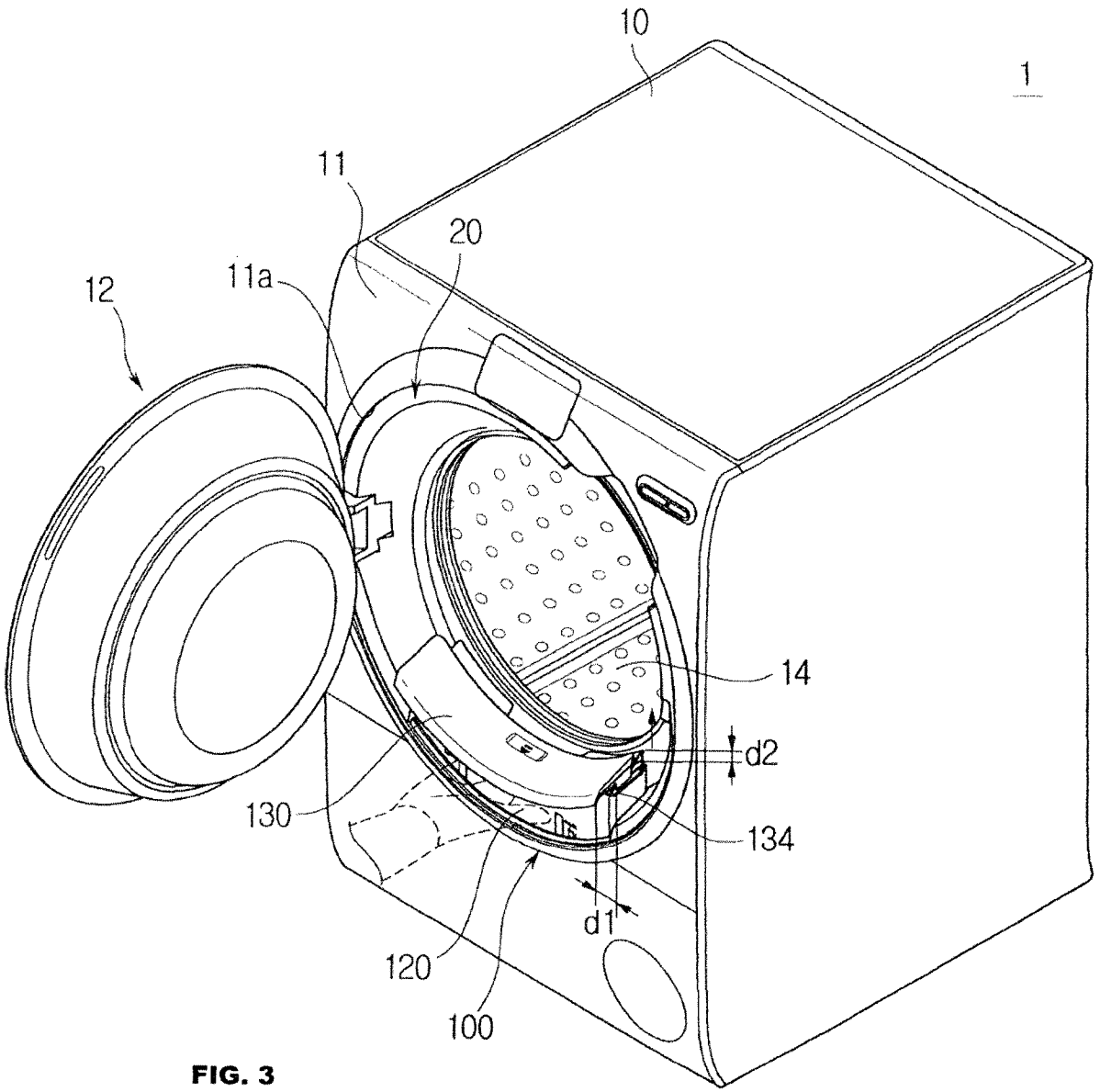
Figure 4:
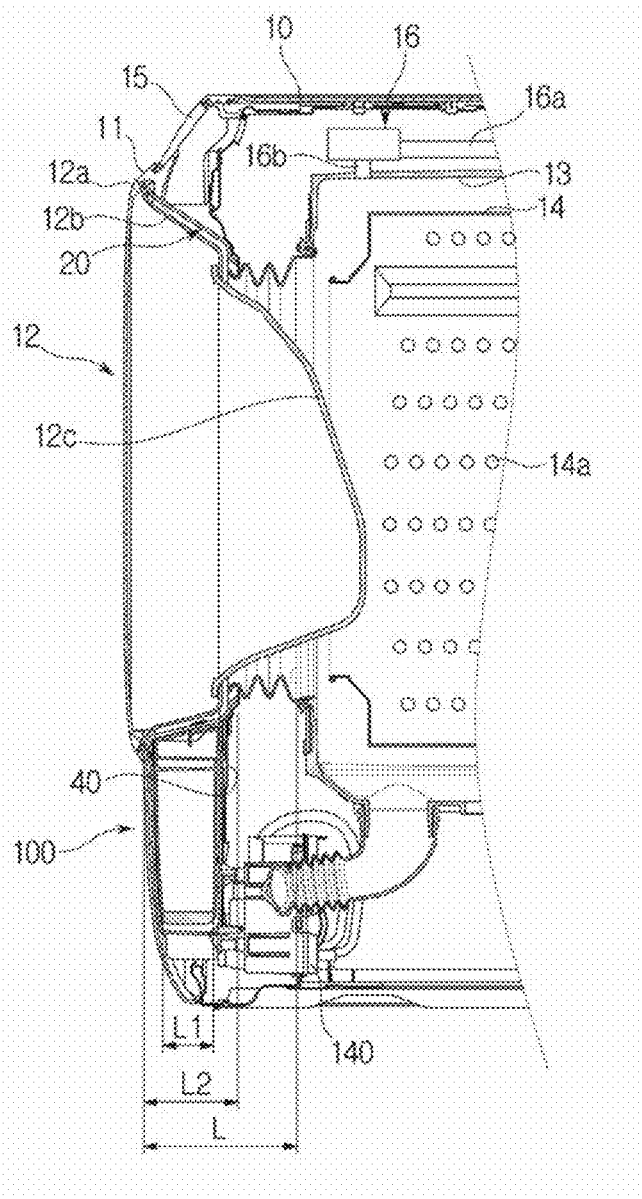
FIG. 4 is a cross-sectional view illustrating a portion taken along line A-A' shown in FIG. 1.
Figure 5:
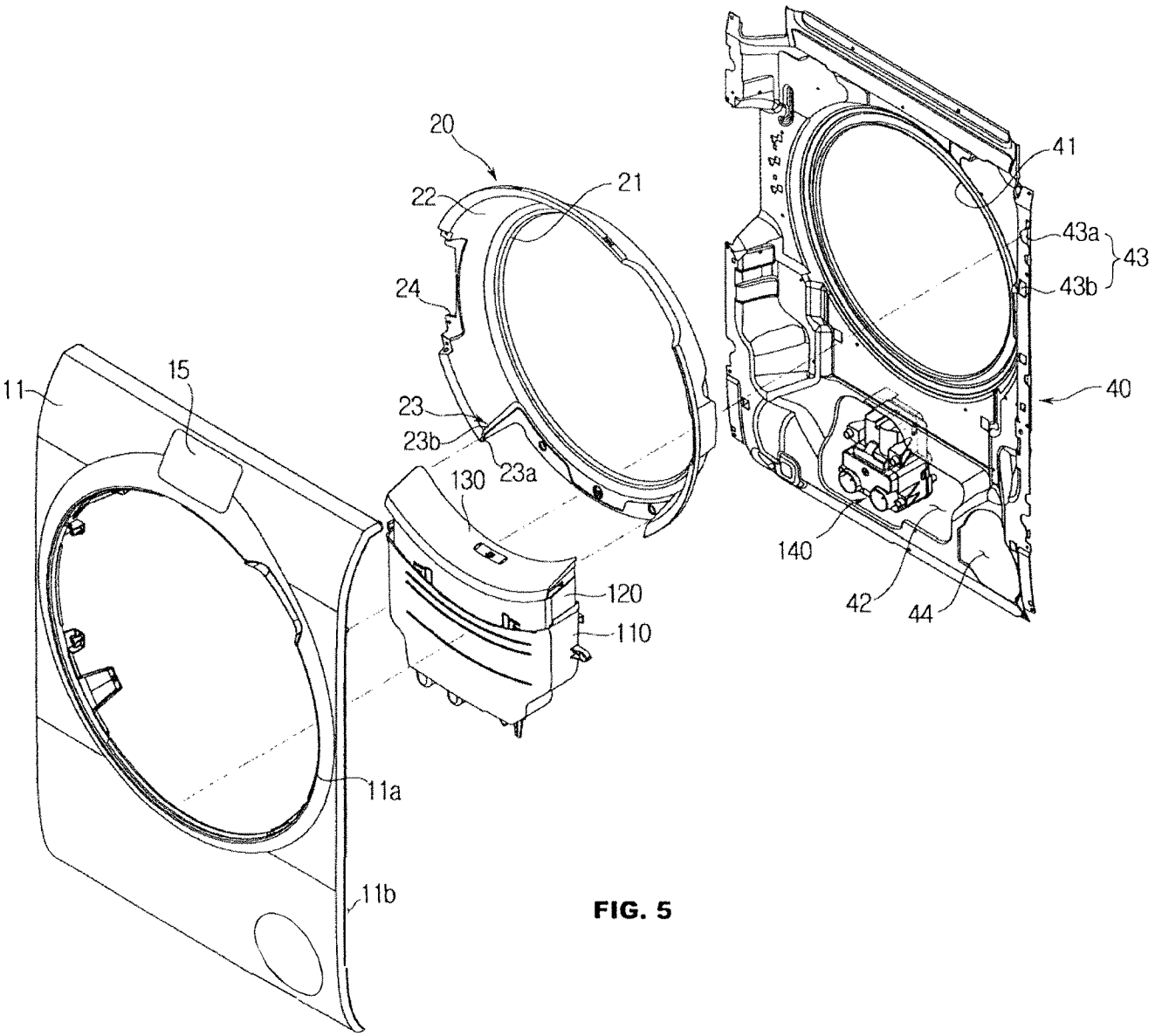
FIG. 5 is a view of a detergent box of the detergent supply apparatus installed in an incision portion in accordance with one embodiment of the present disclosure.

Hereinafter, embodiments of the present disclosure will be described in detail with reference to the attached drawings.

As shown in FIGS. 1 to 5, a washing machine 1 includes a body 10 which forms an external shape, a tub 13 installed in the body 10 to store washing water, and a drum 14 (which may be cylindrical) rotatably installed in the tub 13 and having a plurality of spin-drying holes 14*a* formed on a wall thereof.

An opening portion 11*a* is formed in a front side 11 of the body 10 to allow laundry to be washed to be inserted into or withdrawn from the tub 13 and the drum 14.

Also, a door 12 is installed at the front side 11 of the body 10 to open and close the opening portion 11*a*.

The door 12 may include a first door frame 12*a* and a second door frame 12*b* provided to form an external shape and a door glass portion 12*c* coupled with the rears of the first door frame 12*a* and second door frame 12*b* to be inserted into the body 10.

The first door frame 12*a* forms a front surface and the second door frame 12*b* forms a rear surface.

The door glass portion 12*c* is coupled with a center of the second door frame 12*b* to allow an inside of the drum 14 to be seen, thereby allowing a user to check a washing process with naked eyes during washing. Here, the door glass portion 12*c* may be coupled in a shape of protruding toward the rear of the body 10.

Meanwhile, a door guide 20 is provided at the opening portion 11*a* of the body 10 to guide the door 12 to close the opening portion 11*a*.

The door guide 20 may be formed in a shape corresponding to the second door frame 12*b* which forms a rear surface of the door 12.

The door guide 20 has a ring shape with a circular opening 21 formed in a center thereof and may include a door mounting surface 22 formed to correspond to the second door frame 12*b* of the door 12 in front thereof and an incision portion 23 formed by cutting at least a part of a bottom of the door mounting surface 22.

The door mounting surface 22 may be formed to be inclined from the front side 11 of the body 10 to the rear thereof, that is, toward the tub 13 and the drum 14.

A hinge installation portion 24 may be installed at one side of the door mounting surface 22 to allow the door 12 to be hinge-coupled therewith, and a door latch portion (not shown) may be installed at another side thereof to open and close the door 12.

The incision portion 23 of the door guide 20 may include an opening 23*a* formed toward the front of the body 10 and a detergent box cover mounting portion 23*b* formed to be stepped on a rear circumferential surface of the opening 23*a*.

The detergent box cover mounting portion 23*b* may be formed to be dented from the door mounting surface 22 to allow a detergent box cover 130 of a detergent supply apparatus 100 which will be described below to be coupled therewith.

In the embodiment, it has been shown as an example that the incision portion 23 is formed by cutting at least a part of the door mounting surface 22 of the door guide 20. That is, it has been shown as an example that a width of the incision portion 23 is formed smaller than a width of the door mounting surface 22 to provide the detergent box cover mounting portion 23*b* on at least a part of the door mounting surface 22.

However, the thought of the present embodiment is not limited thereto. For example, the width of the incision portion 23 may be formed to correspond to a width of the door guide 20. As the width of the incision portion 23 increases, a width of the detergent box 120 corresponding to the incision portion 23 may increase together, thereby increasing an amount of a detergent stored in the detergent box 120 according thereto.

Also, in the embodiment, the door guide 20 is provided separately from the front side 11 of the body 10 but is not limited thereto. For example, the door guide 20 may be integrally formed from the opening portion 11*a* in the center of the front side 11.

The door guide 20 may be formed to be bent toward the inside of the body 10, that is, toward the tub 13 along a circumference of the opening portion 11*a* and integrally provided.

Meanwhile, the door guide 20 is allowed to be located on the same plane as the detergent box cover 130. That is, a top surface of the door guide 20 and a top surface of the detergent box cover 130 may be uniformly connected without a gap, thereby improving an aesthetic aspect of a product.

Also, the detergent box cover 130 and the door guide 20 may be formed of the same material, thereby improving an aesthetic shape of a product.

The detergent box cover 130 is coupled with a top end of the detergent box 120 to slidably move forward and backward, moves in front of the body 10 to form a forward movement interval d1, and forms a backward movement interval d2 corresponding to the forward movement interval d1 between the detergent box cover 130 and the incision portion 23 to function as a handle to allow the user to detach the detergent box 120 using the forward movement interval d1 and the backward movement interval d2 of the detergent box cover 130.

Also, a protruding portion 134 formed on a bottom surface of the detergent box cover 130 which moves in front of the body 10 and appears outside the body 10 may be used by the user as a handle.

The user may move the detergent box cover 130 accommodated in the detergent box cover mounting portion 23*b* of the incision portion 23 forward to form the forward and backward movement intervals d1 and d2 thereabove and the protruding portion 134 formed moving in front of the body 10 functions as the handle to be used by the user to withdraw the detergent box 120 outside the body 10, thereby increasing convenience.

Meanwhile, the detergent box cover 130 moves in front of the body 10 to expose a detergent box handle (not shown) provided in the rear of the detergent box 120.

Also, the user may easily withdraw the detergent box 120 outside the body 10 using the exposed detergent box handle.

The incision portion 23 has a first interval L2 to form a space for disposing the detergent box 120 of the detergent supply apparatus 100. The first interval L2 may be smaller than a second interval L between the front side 11 of the body 10 and a front end surface of the tub 13 and may be greater than an interval of the detergent box 120.

A front frame 40 formed with a front frame insertion hole 41 may be provided between the front side 11 of the body 10 and the tub 13 to allow the laundry to be inserted into the drum 14.

The front frame 40 may be disposed between the front side 11 and the tub 13 to support the rear of the door guide 20.

A coupling portion 43 such as a plurality of holes 43*a* and slots 43*b* may be formed on an edge of the front frame 40. The front frame 40 may be coupled with the body 10 through the coupling portion 43 using coupling members such as a screw, a bolt, a pin, a rivet, etc.

The front frame 40 is provided to more stably support the door guide 20 to increase durability of a product.

Meanwhile, at least one coupling protrusion 11*b* is formed on a rear edge of the front side 11 of the body 10 and coupled with the coupling portion 43 of the front frame 40.

The front frame 40 may include a pump installation opening 42 formed by cutting at least a part of a bottom of the front frame 40 to install the detergent supply apparatus 100 and a drainage apparatus installation opening 44 formed by cutting the bottom of the front frame 40 to install a drainage apparatus 30.

A housing 110 may be disposed in front of the front frame 40 through the pump installation opening 42, and a detergent supply pump 140 connected to the rear of the housing 110 may be disposed in the rear of the front frame 40.

Also, the drainage apparatus installation opening 44 of the front frame 40 may be formed to be separate from the pump installation opening 42 in parallel. A drainage case 31 of the drainage apparatus 30 may be disposed in such a way that a filter member (not shown) provided therein may be detachably coupled therewith.

Here, the pump installation opening 42 and the drainage apparatus installation opening 44 of the front frame 40 may be formed in shapes corresponding to the detergent supply pump 140 and the drainage apparatus 30, respectively.

As described above, the detergent supply apparatus 100 capable of storing and automatically supplying a first detergent (hereinafter, referred to as a detergent) and a second detergent (hereinafter, referred to as a fabric softener) is located in the incision portion 23 formed in the bottom in front of the body 10 and the door guide 20, thereby improving user's convenience and increasing usability of a space above the body 10.

Also, a water supply apparatus 16 for supplying water into the tub 13 is mounted in the rear of the body 10. The water supply apparatus 16 may include a first water supply pipe 16*a* connected to an external water supply source (not shown) and a second water supply pipe 16*b* connected to the tub 13, and a water supply valve (not shown) for controlling water supply may be installed on the first water supply pipe 16*a*.

The washing water supplied to the tub 13 through the water supply apparatus 16 is mixed with the detergent and the fabric softener supplied by the detergent supply apparatus 100 in the tub 13 to wash and rinse.

As shown in FIGS. 6 to 14, the detergent supply apparatus 100 includes the housing 110 disposed at the bottom of the inside of the body 10, the detergent box 120 detachably provided in the housing 110 to accommodate the detergent and the fabric softener therein, and the detergent supply pump 140 provided to externally discharge the detergent and the fabric softener in the detergent box 120.

The housing 110 may be disposed on a bottom of the front side 11 of the body 10 and may be installed below a position corresponding to the detergent box cover mounting portion 23*b* of the door guide 20.

The detergent box 120 is provided to be inserted into and detachably coupled with the housing 110, and the detergent box cover 130 is coupled with a top end thereof to be slidable in the front and rear of the body 10.

The detergent box cover 130 is provided on the top end of the detergent box 120. Here, the detergent box cover 130 may be formed to have a size, material, and color corresponding to the detergent box cover mounting portion 23*b* of the door guide 20 not to spoil a design of a product.

The detergent box cover 130 and the detergent box 120 may include slide portions 131 provided to allow the detergent box cover 130 to be movable forward and backward with respect to the detergent box 120.

The slide portions 131 may include guide protrusions 131*a* provided on both ends of the detergent box cover 130, stopping protrusions 132*a* which protrude downward from a center of the bottom surface of the detergent box cover 130, guide rails 131*b* formed on top ends of both sides of the detergent box 120 to correspond to the guide protrusions 131*a* of the detergent box cover 130, and stopping grooves 132*b* which are formed in a center of the top surface of the detergent box 120 and elongate in a width direction of the detergent box 120 to allow the stopping protrusions 132*a* to be inserted and to move therein.

Accordingly, the guide protrusions 131*a* of the detergent box cover 130 are inserted into the guide rails 131*b* of the detergent box 120 to allow the detergent box cover 130 to slide forward and backward with respect to the detergent box 120.

Figure 8:
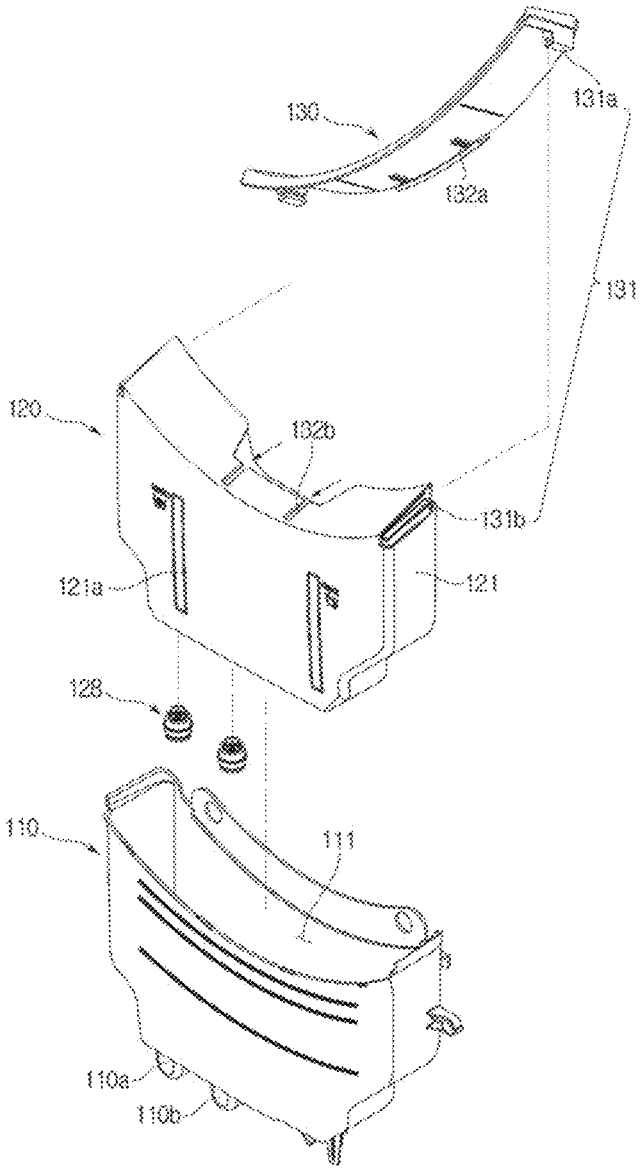
FIG. 8 is an exploded perspective view of the detergent box and a housing in accordance with one embodiment of the present disclosure.

Here, the stopping grooves 132*b* formed on the top surface of the detergent box 120 function as stoppers to allow the stopping protrusions 132*a* of the detergent box cover 130 to be inserted therein not to move more than a length of the stopping grooves 132*b* (refer to FIG. 8).

Figure 6:
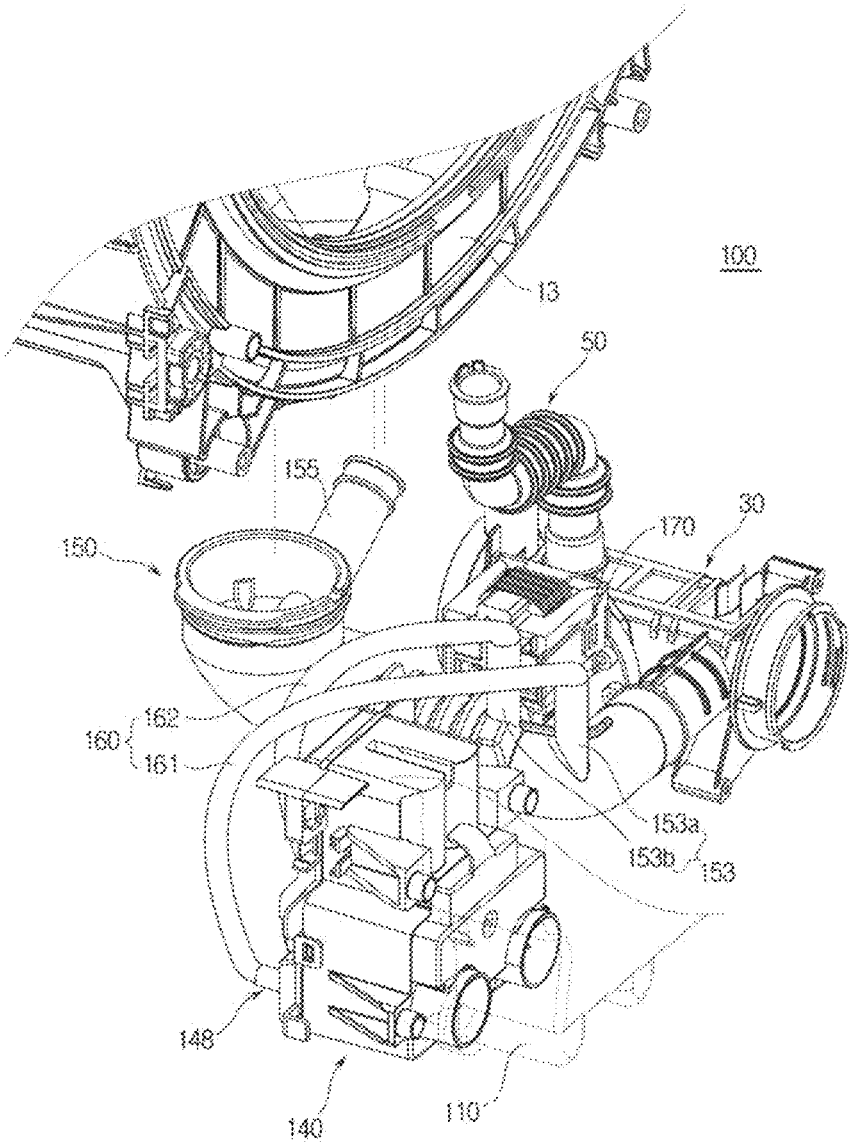
FIG. 6 is a perspective view of the detergent supply apparatus in accordance with one embodiment of the present disclosure.
Figure 7:
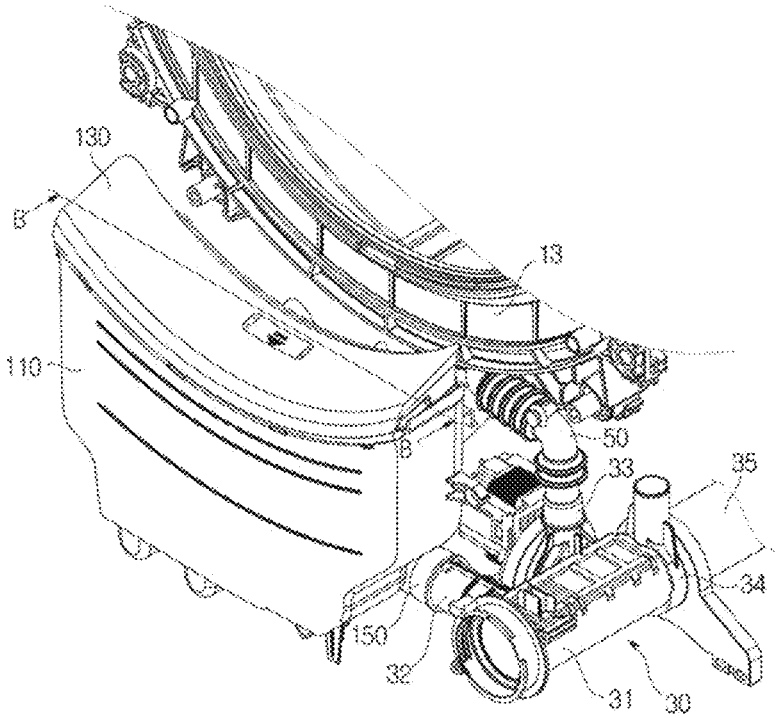
FIG. 7 is a view of the detergent supply apparatus and a drainage apparatus in accordance with one embodiment of the present disclosure.

Meanwhile, as shown in FIGS. 6 and 7, the body 10 includes the drainage apparatus 30 to forcibly discharge the washing water of the tub 13, a circulating pump 170 provided in the drainage apparatus 30 to circulate the washing water of the tub 13, a first connection pipe 150 which connects the tub 13 with the drainage apparatus 30, and a second connection pipe 50 which connects the tub 13 with the circulating pump 170.

The first connection pipe 150 is formed to allow one end to be connected to a bottom surface of the tub 13 and another end to be connected to the drainage apparatus 30. A branch pipe 155 which branches off from the first connection pipe 150 may be connected to the tub 13 to be connected to a pressure sensor 190 to measure an amount of the washing water in the tub 13 (refer to FIG. 15).

Also, detergent connection pipes 153 formed to be connected to the detergent supply pump 140 are formed on the first connection pipe 150. The detergent connection pipes 153 may include a first detergent connection pipe 153*a* and a second detergent connection pipe 153*b*.

The drainage apparatus 30 may include a drainage pump (not shown) which allows the washing water to be discharged outward, the circulating pump 170 which allows the washing water to be circulated around the tub 13, and a filter member (not shown) provided to filter out foreign substances included in the washing water.

The drainage apparatus 30 includes a drainage case 31 provided to accommodate the filter member and to connect the drainage pump with the circulating pump 170. The drainage case 31 includes a first connection pipe 32 connected to the first connection pipe 150 to be connected to the tub 13 to receive the washing water from the tub 13, a second connection pipe 33 connected to the second connection pipe 50 to connect the drainage case 31 with one side of the tub 13 while being connected to the circulating pump 170 which allows the washing water to be circulated, and a third connection pipe 34 connected to a drainage hose 35 to guide the washing water which flows into the drainage case 31 to the outside of the body 10.

Here, a front side of the drainage case 31 may be formed to be open to allow a drainage filter to be detachable from the front side of the drainage case 31.

Meanwhile, a detergent supply pipe 160 connected to the detergent supply pump 140 to supply the detergent and the fabric softener is connected to the first detergent connection pipe 153*a* and the second detergent connection pipe 153*b* of the first connection pipe 150 to allow the detergent and the fabric softener supplied through the detergent supply pipe 160 to be supplied to the tub 13 through the circulating pump 170.

In the embodiment of the present disclosure, the detergent supply pipe 160 of the detergent supply apparatus 100 is shown to be connected to the tub 13 through the circulating pump 170, the first connection pipe 150, and the second connection pipe 50 but is not limited thereto. For example, the detergent supply pipe 160 may be directly connected to a tub.

Figure 9:
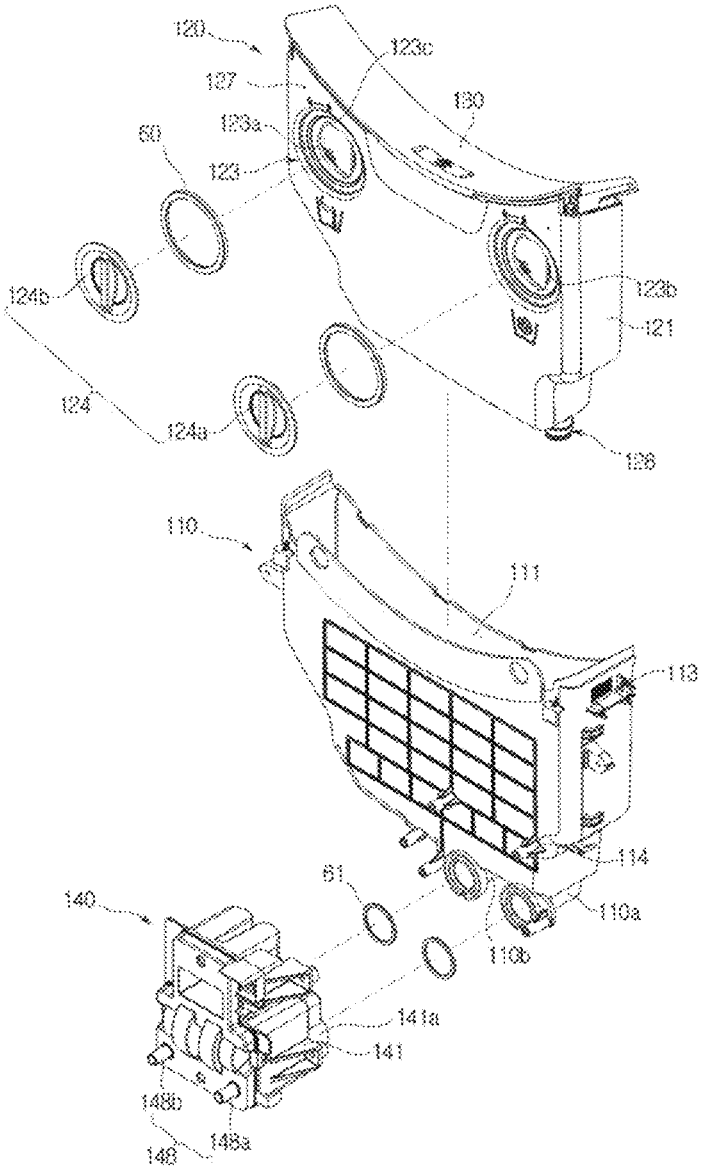
FIG. 9 is an exploded perspective view of the detergent box, the housing, and a detergent supply pump in accordance with one embodiment of the present disclosure.
Figure 10:
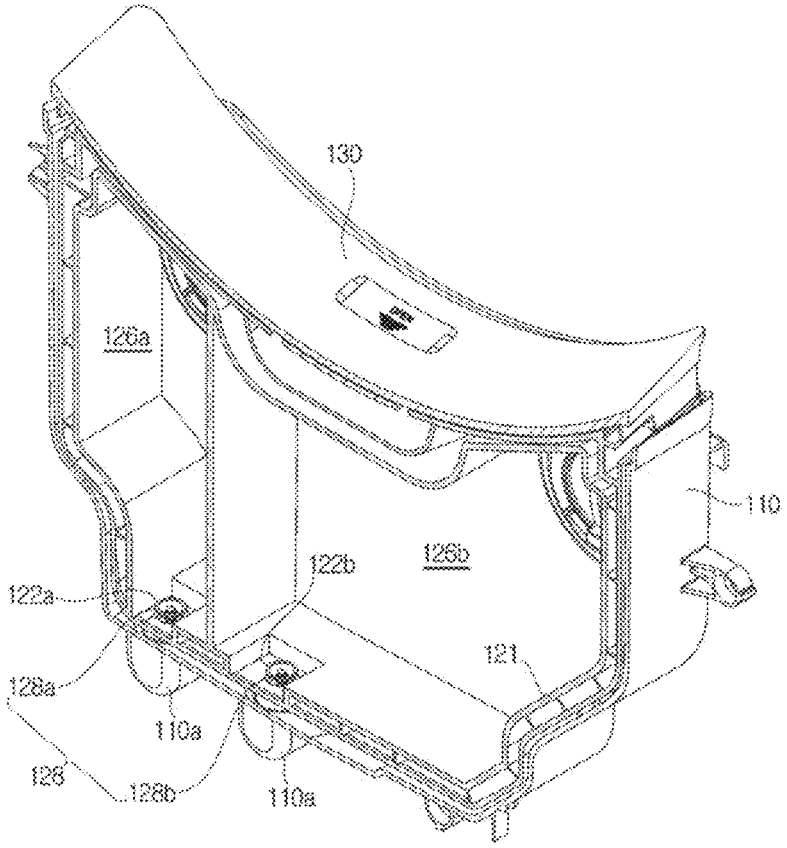
FIG. 10 is a configuration diagram illustrating an inside of the detergent box coupled with the housing in accordance with one embodiment of the present disclosure.
Figure 11:
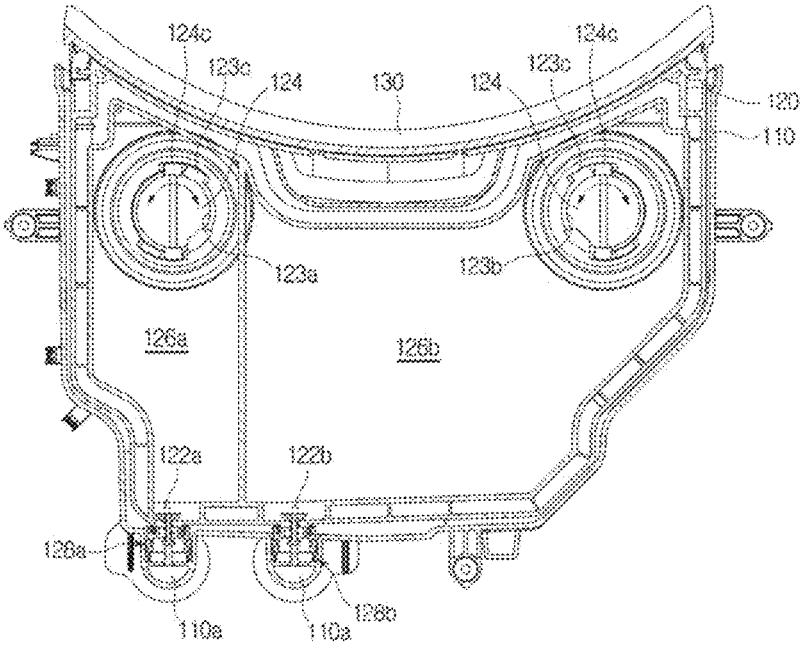
FIG. 11 is a cross-sectional view illustrating a portion taken along line B-B' shown in FIG. 7.
Figure 12:
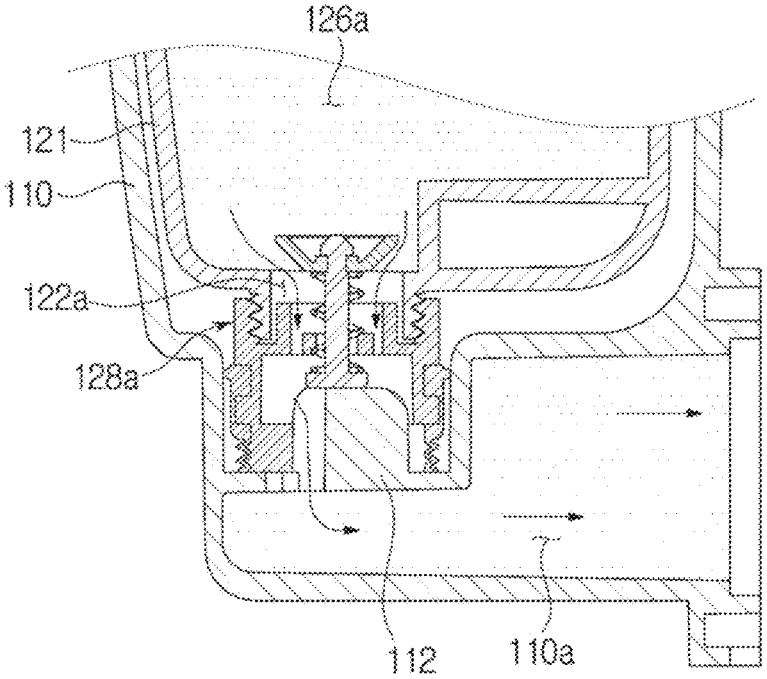
FIG. 12 is a view illustrating a state of supplying a detergent from the detergent box mounted in the housing in accordance with one embodiment of the present disclosure.

As shown in FIGS. 8 to 10, the detergent box 120 of the detergent supply apparatus 100 includes a detergent box body 121 formed with a first accommodating portion 126*a* provided to accommodate the detergent therein and a second accommodating portion 126*b* provided to accommodate the fabric softener therein.

Detergent check windows 121*a* may be formed on a front surface of the detergent box body 121 to allow the user to check residual amounts of the detergent and the fabric softener with eyes. The detergent check windows 121*a* may be formed of a completely transparent material or an opaque material and may be insert-injection-molded during a process of injection-molding the detergent box body 121.

The detergent box body 121 includes detergent supply portions 123 provided to supply the detergent and the fabric softener to the first accommodating portion 126*a* and the second accommodating portion 126*b*, respectively, and detergent ejection portions 122 provided to eject the detergent and the fabric softener to be ejected from the first accommodating portion 126*a* and the second accommodating portion 126*b*.

In the embodiment of the present disclosure, it has been shown as an example that the first accommodating portion 126*a* of the detergent box body 121 stores the detergent and the second accommodating portion 126*b* stores the fabric softener. However, the concept of the present disclosure is not limited thereto.

The detergent supply portions 123 may be provided in a rear side of the detergent box body 121, respectively, and include a first detergent supply portion 123*a* formed to supply the detergent to the first accommodating portion 126*a* and a second detergent supply portion 123*b* formed to supply the fabric softener to the second accommodating portion 126*b*.

Also, caps 124, 124*a*, and 124*b* for opening and closing the first detergent supply portion 123*a* and the second detergent supply portion 123*b*, respectively, may be provided. The caps 124, 124*a*, and 124*b* are formed to correspond to shapes of the first detergent supply portion 123*a* and the second detergent supply portion 123*b*. In the embodiment, the caps 124, 124*a*, and 124*b* include protrusions 124*c*. The first detergent supply portion 123*a* and the second detergent supply portion 123*b* are provided to be formed with grooves 123*c* corresponding to the protrusions 124*c* of the caps 124, 124*a*, and 124*b* to allow the caps 124, 124*a*, and 124*b*, respectively, to rotate in the first detergent supply portion 123*a* and the second detergent supply portion 123*b* and to be fixed by the protrusions 124*c* and the grooves 123*c*.

In the embodiment, it has been shown as an example that the detergent supply portions 123 and the caps 124 have circular shapes. However, the concept of the present disclosure is not limited thereto. For example, detergent supply portions and caps may have quadrilateral or various shapes.

Meanwhile, a sealing member 60 for sealing may be provided between the detergent supply portions 123 and the caps 124.

The first detergent ejection portion 122*a* and second detergent ejection portion 122*b* are provided at bottom ends of the first accommodating portion 126*a* and the second accommodating portion 126*b*, respectively and may include a first detergent ejection portion 122*a* formed at the bottom end of the first accommodating portion 126*a* and a second detergent ejection portion 122*b* formed at the bottom end of the second accommodating portion 126*b*.

Also, the first detergent ejection portion 122*a* and the second detergent ejection portion 122*b* may be coupled with a pair of valves 128, first valve 128*a*, and second valve 128*b* to control ejection amounts of the detergent and the fabric softener between the accommodating portion and the housing, respectively.

The first valve 128*a* is provided on the first detergent ejection portion 122*a* of the detergent box 120 and the second valve 128*b* is provided on the second detergent ejection portion 122*b*.

The valve 128, the first valve 128*a*, and the second valve 128*b* may be coupled with valve coupling portions 112 of the housing 110, which will be described below, and be opened to allow the detergent and the fabric softener accommodated in the first accommodating portion 126*a* and the second accommodating portion 126*b*, respectively, to be ejected. Here, the valves 128, the first valve 128*a*, and the second valve 128*b* may include a check valve.

Also, the detergent box body 121 may be formed with an air through-hole 127 formed to penetrate the first accommodating portion 126*a* and the second accommodating portion 126*b* to allow outside air to flow therethrough. The air through-hole 127 allows a pressure inside the detergent box body 121 to be uniformly maintained, thereby smoothly ejecting the detergent and the fabric softener.

In the embodiment of the present disclosure, the air through-hole 127 is shown as a hole with a predetermined diameter as an example but is not limited thereto. For example, an opening and closing member such as a damper may be included.

The housing 110 is provided with a detergent accommodating portion 111 provided to allow the detergent box body 121 to be inserted and accommodated therein, and a first reservoir 110*a* provided to be connectable with the first accommodating portion 126*a* of the detergent box 120 and a second reservoir 110*b* provided to be connectable with the second accommodating portion 126*b* are formed on a bottom end of the detergent accommodating portion 111.

The first reservoir 110*a* and the second reservoir 110*b* of the housing 110 are formed to be connected to the first detergent ejection portion 122*a* and the second detergent ejection portion 122*b* of the first accommodating portion 126*a* and the second accommodating portion 126*b* of the detergent box 120, respectively, to receive the detergent and the fabric softener.

The valve coupling portions 112 may be formed on the first reservoir 110*a* and the second reservoir 110*b* to allow the valve 128, the first valve 128*a*, and the second valve 128*b*, coupled with the first detergent ejection portion 122*a* and the second detergent ejection portion 122*b* at the bottom surface of the detergent box body 121 to be coupled therewith and opened.

In the embodiment, it has been shown as an example that the housing 110 includes the first reservoir 110*a* and the second reservoir 110*b* provided to receive the detergent and the fabric softener from the detergent box 120. However, the concept of the present disclosure is not limited thereto. For example, at least one of a first reservoir and a second reservoir may be omitted.

Also, in the embodiment, the valve coupling portions 112 are shown as protrusions which protrude upward to be coupled with the valve 128, the first valve 128*a*, and the second valve 128*b* and to be opened but are not limited thereto.

Meanwhile, a mounting sensor 113 which senses whether the detergent box 120 is coupled with or separated from the housing 110 may be installed in the housing 110. The mounting sensor 113 which includes magnets are installed in positions corresponding to a side of the housing 110 and a side of the detergent box body 121, respectively, to display sensed content on a display unit 15 when the detergent and the fabric softener in the detergent box 120 are replaced.

A detergent supply pump coupling portion 114 for coupling with the detergent supply pump 140 may be formed at a bottom of a rear surface of the housing 110.

The detergent supply pump 140 may be installed to be connectable to the first reservoir 110*a* and the second reservoir 110*b* to receive the detergent and the fabric softener from the housing 110. For this, a sealing member 61 for sealing may be provided between the housing 110 and the detergent supply pump 140.

The detergent supply pump 140 may be provided with a fixing portion 141*a* which has a shape corresponding to the detergent supply pump coupling portion 114 of the housing 110.

Figure 13:
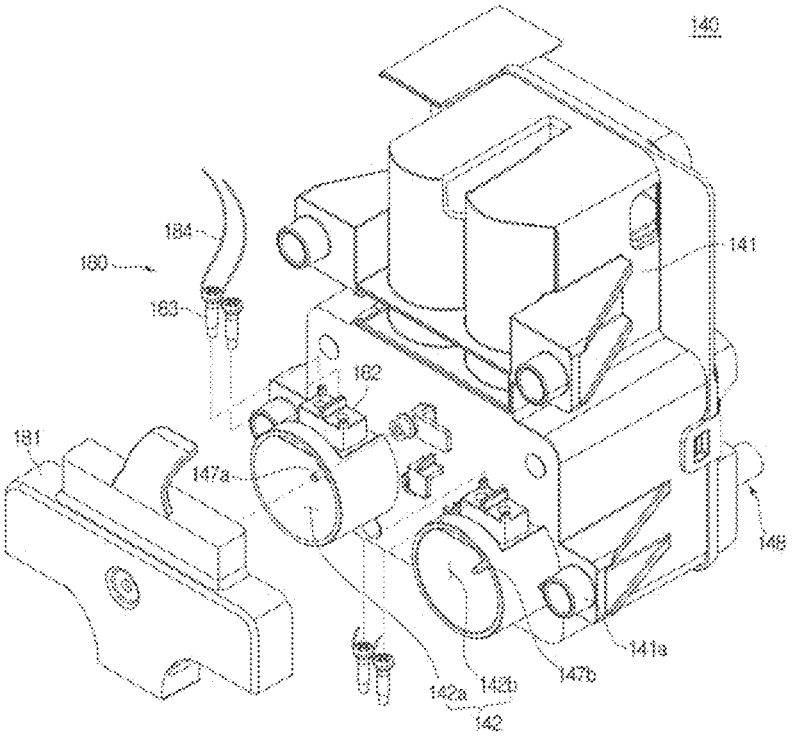
FIG. 13 is a view of a sensor portion installed in the detergent supply pump in accordance with one embodiment of the present disclosure.
Figure 14:
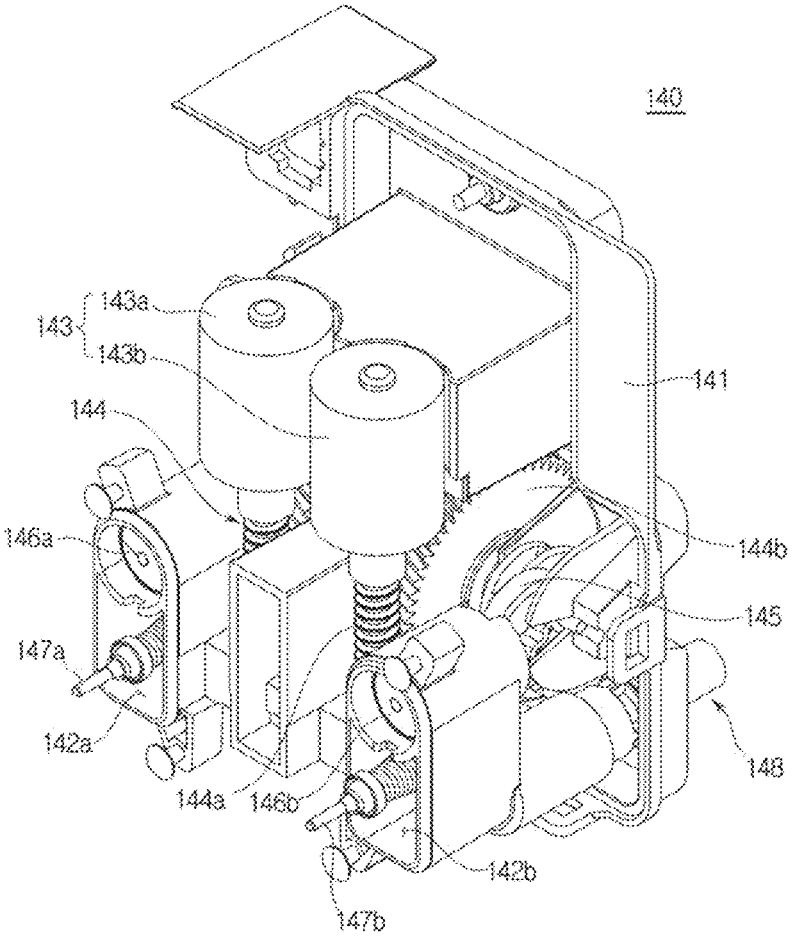
FIG. 14 is a configuration diagram illustrating an inside of the detergent supply pump in accordance with one embodiment of the present disclosure.

FIG. 13 is a view of a sensor unit installed in the detergent supply pump in accordance with one embodiment of the present disclosure, and FIG. 14 is an configuration diagram illustrating an inside of the detergent supply pump in accordance with one embodiment of the present disclosure.

As shown in FIGS. 13 and 14, the detergent supply pump 140 may include a pump housing 141 provided to be connected to the housing 110 and to form an external shape, chambers 142 provided in the pump housing 141 and connected to the first reservoir 110*a* and the second reservoir 110*b* of the housing 110, a piston members 146 provided to apply pressure to an inside of the chambers 142, a motor 143 provided to drive the piston members 146, and gear members 144 which connect the motor 143 with the piston member 146.

The chambers 142 include a first chamber 142*a* connected to the first reservoir 110*a* and a second chamber 142*b* connected to the second reservoir 110*b*. The first chamber 142*a* may receive the liquid detergent stored in the first reservoir 110*a*, and the second chamber 142*b* may receive the fabric softener stored in the second reservoir 110*b*.

Also, a sensor portion 180 for measuring whether the detergent and the fabric softener supplied to the first chamber 142*a* and the second chamber 142*b* are present may be installed in the pump housing 141.

The sensor portion 180 may include a sensor installation portion 182 disposed on one side of the pump housing 141 to be connectable to the first chamber 142*a* and the second chamber 142*b*, a sensor cover 181 formed to surround an outside of the sensor installation portion 182, a sensor 183 installed in the sensor installation portion 182, and a wire 184 provided to be connected to the sensor and to transmit the presence or absence of the detergent and the fabric softener measured by the sensor 183 to a control unit (not shown).

Here, the sensor 183 may be disposed to be in contact with the detergent and the fabric softener in the first chamber 142*a* and the second chamber 142*b*. In the embodiment, the sensor 183 is shown as a screw as an example but is not limited thereto.

The presence or absence of the detergent and the fabric softener detected by the sensor 183 may be transmitted to the display unit 15 through the control unit to display presence or absence check information of the detergent.

Outlets 148 provided to be connected to the chamber 142 to discharge the detergent and the fabric softener are provided in the pump housing 141 of the detergent supply pump 140. The outlets 148 include a first outlet 148*a* to be connectable to the first chamber 142*a* and a second outlet 148*b* to be connectable to the second chamber 142*b*.

The piston members 146 provided to apply the pressure to the inside of the chambers 142 include a first piston member 146*a* provided in the first chamber 142*a* and a second piston member 146*b* provided in the second chamber 142*b*.

Also, both the motors 143 provided to drive the first piston member 146*a* and the second piston member 146*b*, respectively, and the gear members 144 may be provided in pairs, respectively.

The first piston member 146*a* and the second piston member 146*b* control internal pressure of the first chamber 142*a* and the second chamber 142*b* to allow the detergent stored in the first chamber 142*a* and the fabric softener stored in the second chamber 142*b* to be discharged through the first outlet 148*a* and the second outlet 148*b*.

The first piston member 146*a* connected to a first motor 143*a* moves up and down in the first chamber 142*a* and controls the pressure inside the first chamber 142*a*.

Here, between the first piston member 146*a* and the first motor 143*a*, a worm shaft 144*a* which is connected to the first motor 143*a* and rotates, a worm gear 144*b* provided to be engaged with the worm shaft 144*a* and to rotate, and a cam member 145 connected to the worm gear 144*b* to move the first piston member 146*a* may be provided.

Accordingly, when the first motor 143*a* rotates, the worm shaft 144*a* connected to the first motor 143*a* rotates, the worm gear 144*b* connected to the worm shaft 144*a* rotates, the cam member 145 connected to the worm gear 144*b* rotates, and the piston member 146 connected to the cam member 145 moves, thereby applying the pressure to an inside of the first chamber 142*a*.

Due to a change in the pressure inside the first chamber 142*a*, the liquid detergent stored in the first reservoir 110*a* is allowed to move toward the first chamber 142*a* through the check valve 147 and the liquid detergent of the first chamber 142*a* is allowed to be discharged outside the detergent supply pump 140 through the first outlet 148*a*.

As described above, the liquid detergent discharged through the first outlet 148*a* is supplied to the first connection pipe 150 through a first detergent supply pipe 161 connected to the first outlet 148*a*.

Since an operation of discharging the fabric softener through the second outlet 148*b* in the second chamber 142*b* due to the rotation of the second motor 143*b* is identical to that of the first chamber 142*a* of the first motor 143*a*, a detailed description thereof will be omitted.

The fabric softener discharged through the second outlet 148*b* may be supplied to the first connection pipe 150 through a second detergent supply pipe 162.

In the embodiment, it has been shown as an example that the detergent supply pump 140 is operated by moving the piston members due to the respective motors. However, the concept of the present disclosure is not limited thereto. For example, it is possible to selectively control the pressures of the chambers by driving one motor.

Figure 15:
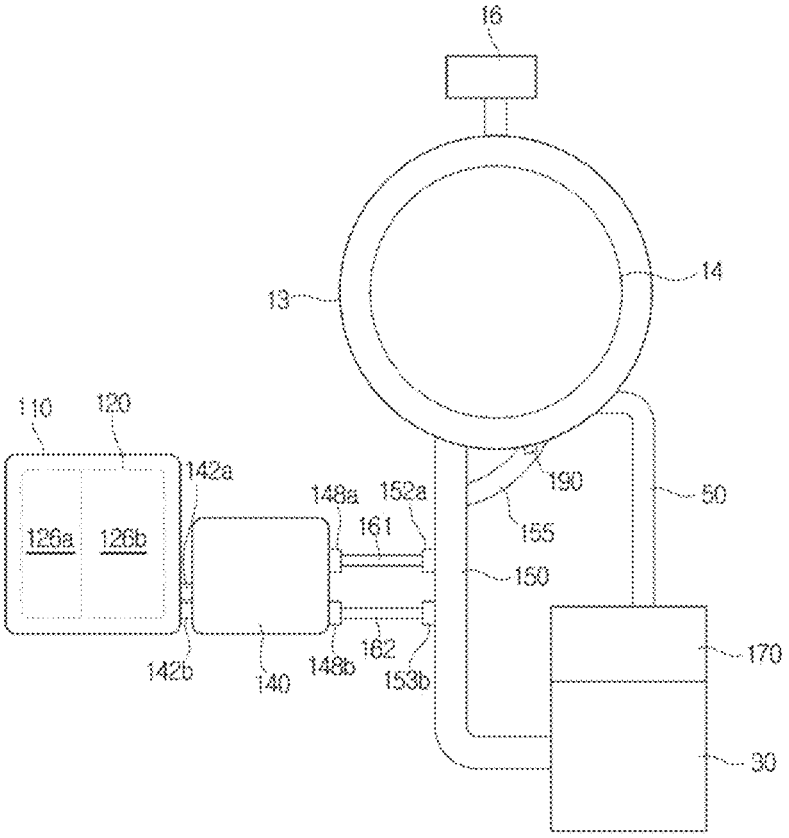
FIG. 15 is a schematic diagram illustrating an operation of the detergent supply apparatus in accordance with one embodiment of the present disclosure.

FIG. 15 is a schematic diagram illustrating an operation of the detergent supply apparatus in accordance with one embodiment of the present disclosure.

As shown in FIG. 15, in the case of the detergent and the fabric softener stored in the first accommodating portion 126*a* and the second accommodating portion 126*b* of the detergent box 120, respectively, during a washing operation, the washing water is supplied from the water supply apparatus 16 to the tub 13 and the detergent stored in the first accommodating portion 126*a* in the detergent box 120 is moved by the detergent supply pump 140 to the first connection pipe 150 through the first outlet 148*a* and the first detergent supply pipe 161.

The detergent of the first connection pipe 150 moves together with the washing water discharged from the tub 13 to the circulating pump 170 and is supplied to the tub 13 through the second connection pipe 50, thereby performing washing.

When the washing is completed, the washing water is discharged through the drainage apparatus 30. During a rinsing operation, when water is supplied to the tub 13 from the water supply apparatus 16, the fabric softener stored in the second accommodating portion 126*b* in the detergent box 120 is moved by the second detergent supply pipe 162 to the first connection pipe 150 through the second outlet 148*b* of the detergent supply pump 140.

The fabric softener of the first connection pipe 150 moves together with the washing water discharged from the tub 13 to the circulating pump 170 and moves into the tub 13 through the second connection pipe 50, thereby performing the rinsing operation. When the rinsing is completed, the washing water is discharged outside the body 10 through the drainage apparatus 30.

Figure 16:
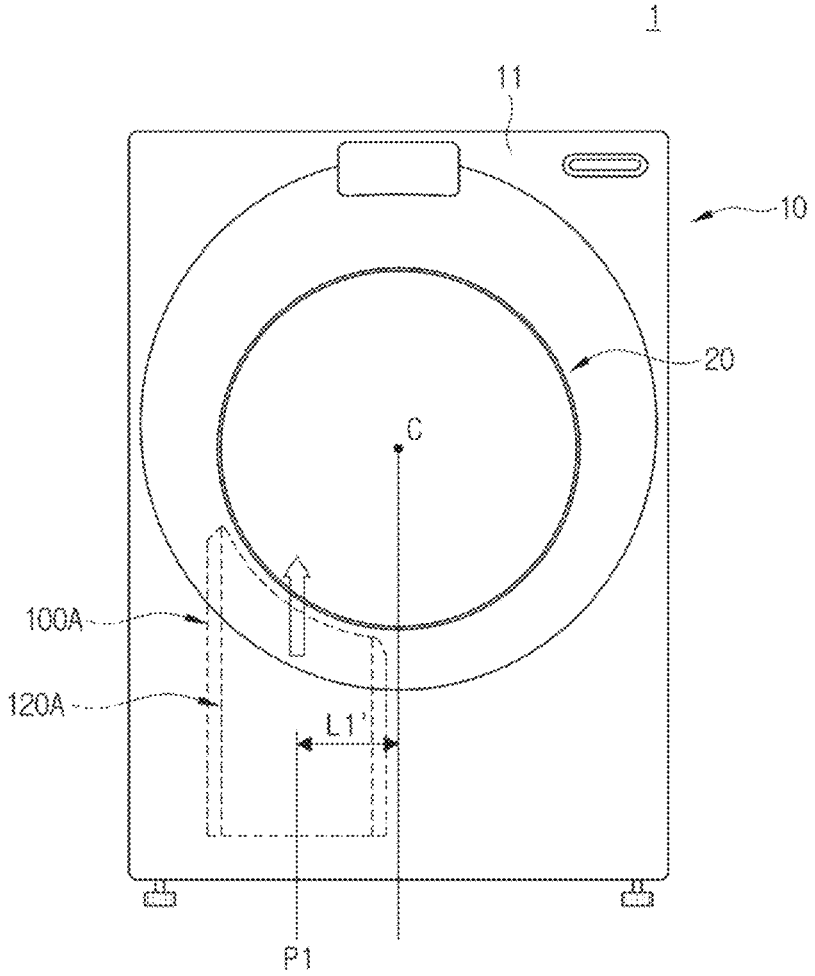
FIGS. 16 and 17 are schematic diagrams of a washing machine in which a detergent box of a detergent supply apparatus is mounted in accordance with another embodiment of the present disclosure.
Figure 17:
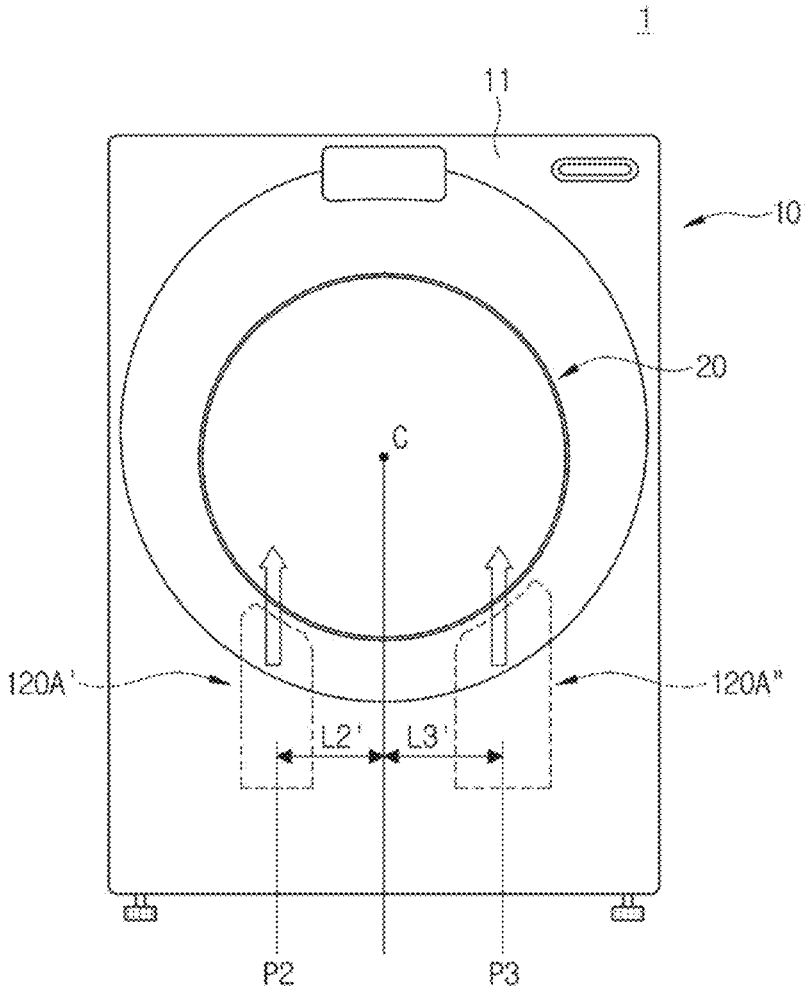
Figure 18:
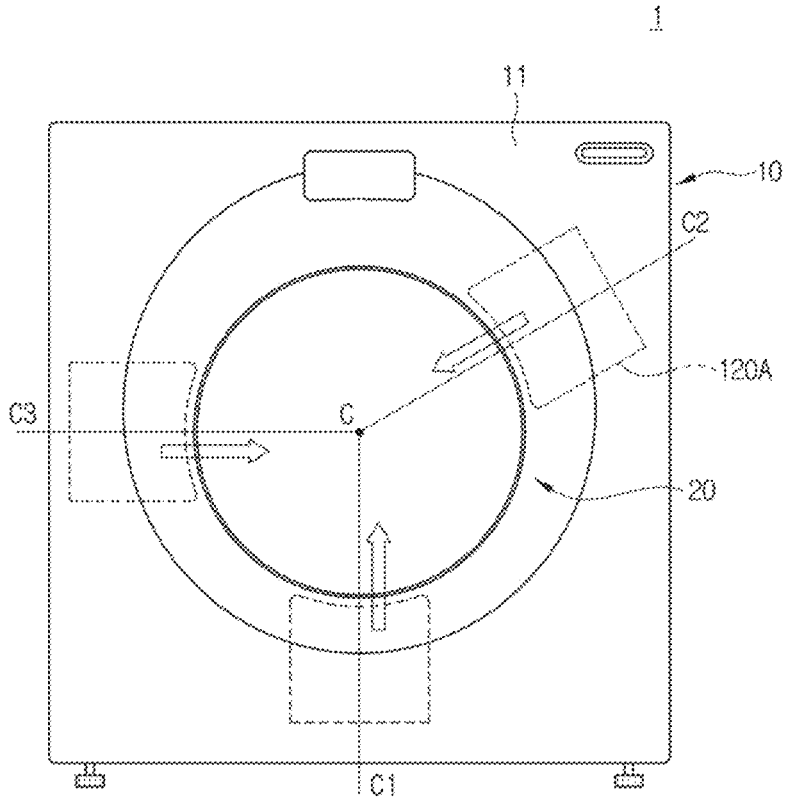
FIG. 18 is a schematic diagram of a washing machine in which a detergent box of a detergent supply apparatus is mounted in accordance with another embodiment of the present disclosure.

FIGS. 16 and 18 are schematic diagrams of a washing machine in which a detergent box of a detergent supply apparatus is mounted in accordance with other embodiments of the present disclosure.

Hereinafter, the detergent supply apparatus and the washing machine having the same in accordance with other embodiments of the present disclosure will be described.

In the embodiment, it has been shown as an example that the detergent supply apparatus 100 and the detergent box 120 are disposed in front of the door guide 20 at the bottom in the center thereof. However, the concept of the present disclosure is not limited thereto.

For example, detergent boxes 120A of a detergent supply apparatus 100 or 100A may be disposed on one side of a circumferential surface of the door guide 20 in a circumferential direction thereof.

The detergent boxes 120A disposed in at least one direction of the door guide 20 may be disposed on one side of a top and a bottom of a first position P1 spaced a predetermined interval L1' from a center C of the door guide 20 in a left direction.

Also, the detergent box 120A, the first detergent box 120A', and the second detergent box 120A" may be formed to be separate to store only a detergent or a fabric softener. For example, a first detergent box 120A' provided to store only the detergent and a second detergent box 120A" provided to store only the fabric softener may be included.

Here, the first detergent box 120A' may be disposed in at least one position of a top and a bottom of a second position P2 spaced a predetermined interval L2' from a left side of the body 10, that is, from a center C to the left side.

Also, the second detergent box 120A" may be disposed in at least one position of a top and a bottom of a third position P3 spaced a predetermined interval L3' from a right side of the body 10, that is, from the center C to the right side.

Here, the detergent boxes 120A may have various sizes and shapes.

Meanwhile, the detergent boxes 120A, the first detergent box 120A', and the second detergent box 120A" may be disposed to allow the center C of the door guide 20 and centers of the first detergent box 120A' and the second detergent box 120A" to be separate from one another to move upward when the first detergent box 120A' and the second detergent box 120A" are separated or detached.

Here, the detergent boxes 120A, the first detergent box 120A', and the second detergent box 120A" may be disposed on a bottom side based on a center of the door guide 20 in a horizontal direction.

Also, when the detergent boxes 120A, the first detergent box 120A', and the second detergent box 120A" are moved upward and withdrawn as described above, the sizes and shapes of the detergent boxes 120A, the first detergent box 120A', and the second detergent box 120A" may be appropriately changed according to a size of the opening portion 11*a* of the body 10 to be withdrawable.

As shown in FIG. 18, the detergent boxes 120A may be disposed to allow the center C of the door guide 20 and the center of the detergent boxes 120A to be identical to each other to be attached or detached in a circle center C direction when detergent boxes 120A are separated and detached.

For example, detergent boxes 120A may be disposed in positions such as a bottom end C1 at 6 o'clock, a right side C2 at 3 o'clock, or a left side C3 at 9 o'clock from the center C of the door guide 20.

Meanwhile, according to a change in the arrangement of the detergent box 120A, the first detergent box 120A', and the second detergent box 120A", arrangements of the detergent supply pump 140 connected to the detergent box 120A, the first detergent box 120A', and the second detergent box 120A" to discharge the detergents of the detergent box 120A, the first detergent box 120A', and the second detergent box 120A" and pipes connected to the detergent supply pump 140 may be changed.

Also, according to the change in the arrangement of the detergent box 120A, the first detergent box 120A', and the second detergent box 120A", a size and a shape of the body 10 of the washing machine 1 may be changed.

Figure 19:
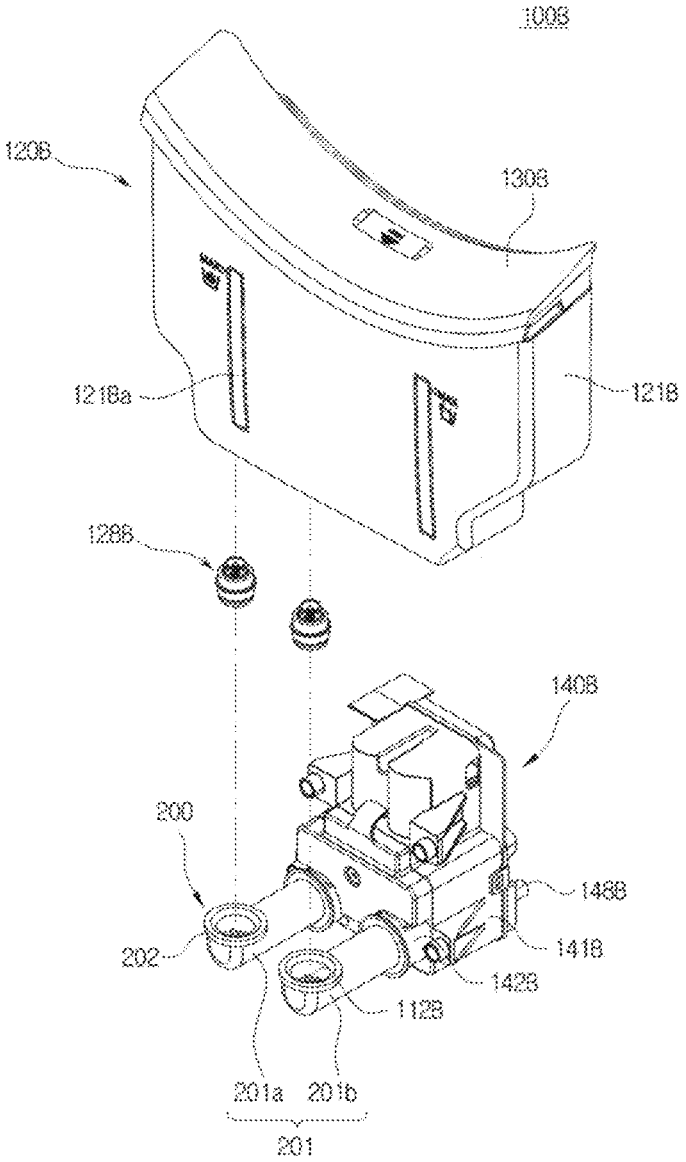
FIG. 19 is a schematic perspective view illustrating a detergent supply apparatus in accordance with still another embodiment of the present disclosure.

FIG. 19 is a schematic perspective view illustrating a detergent supply apparatus 100B in accordance with still another embodiment of the present disclosure.

The detergent supply apparatus 100 in accordance with one embodiment of the present disclosure is provided to include the housing 110 disposed on the bottom inside the body 10 in front thereof, the detergent box 120 detachably provided in the housing 110, and the detergent supply pump 140 provided to discharge the detergent in the detergent box 120.

As shown in FIG. 19, in accordance with still another embodiment of the present disclosure, the detergent supply apparatus 100B may be provided including a detergent box 120B and a detergent supply pump 140B provided to discharge a detergent of the detergent box 120B.

Here, a pump connection member 200 which connects the detergent box 120B with the detergent supply pump 140B may be further included.

The detergent box 120B may be provided to be inserted in the incision portion 23 of the door guide 20 to be detachable, and a detergent box cover 130B may be coupled with a top end thereof to be slidable in the front and rear of the body 10.

The detergent box cover 130B may be formed to correspond to the size of the incision portion 23.

The detergent box 120B includes a detergent box body 121B in which an accommodating portion 126 is provided to accommodate a detergent and a fabric softener therein.

A detergent check window 121Ba may be formed on a front surface of the detergent box body 121B to allow the user to check residual amounts of the detergent and the fabric softener.

The detergent box body 121B may include a detergent ejection portion 122 provided to allow the detergent and the fabric softener to be discharged from the accommodating portion 126 and a valve 128B provided on the detergent ejection portion to control discharge amounts of the detergent and the softener.

The pump connection member 200 is disposed on the bottom of the body 10. The pump connection member 200 may be connected to the detergent supply pump 140B.

The detergent supply pump 140B may include a pump housing 141B, a chamber 142B provided inside the pump housing 141B, and an outlet 148B provided to be connected to the chamber 142B to discharge the detergent and the fabric softener.

The pump connection member 200 includes reservoirs 201 provided to be connectable to the chamber 142B of the pump housing 141B and to receive the detergent and the fabric softener supplied from the detergent box 120B.

The reservoirs 201 may include a first reservoir 201*a* provided to receive and store the detergent and a second reservoir 201*b* provided to receive and store the fabric softener.

The pump connection member 200 may be formed with valve guides 202 for smoothly guiding couplings with the detergent box 120B at top ends of the reservoir 201, respectively.

The reservoir 201, the first reservoir 201*a*, and the second reservoir 201*b* of the pump connection member 200 are provided with valve coupling portions 112B to allow the valves 128B of the detergent box 120B. The valve coupling portions 112B may be disposed inside the valve guides 202.

The valve coupling portions 112B are coupled with the valves 128B provided on the detergent ejection portions 122 of the detergent boxes 120B while the detergent boxes 120B are attached or detached to allow the valves 128B to be open.

In the embodiment, it has been shown as an example that the valve coupling portions 112B have protruding shapes which protrude to pressurize the valves 128B upward. However, the concept of the present disclosure is not limited thereto.

Also, in the embodiment, it has been described as an example that the valve guides 202 are formed in circular shapes to guide insertion and assembling of the valves 128B of the detergent boxes 120B. However, the concept of the present disclosure is not limited thereto. For example, the valve guides 202 may be variously formed depending on shapes and sizes of the detergent ejection portions of the detergent boxes.

Figure 20:
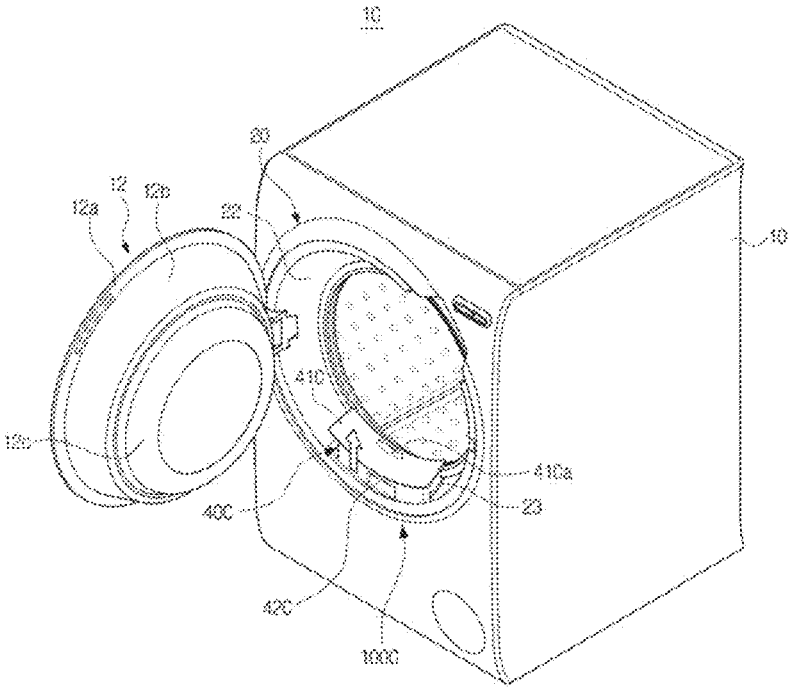
FIG. 20 is a schematic perspective view illustrating a state in which a detergent box of a detergent supply apparatus pops up or passes through in accordance with still another embodiment of the present disclosure.

FIG. 20 is a schematic perspective view illustrating a state in which a detergent box of a detergent supply apparatus pops up or passes through in accordance with still another embodiment of the present disclosure.

As shown in FIG. 20, the detergent supply apparatus 100C may be provided to allow a detergent box 40C to pop up or pass through from the incision portion 23 of the door guide 20.

The door guide 20 may include a door mounting surface 22 formed to correspond to the second door frame 12*b* of the door 12 in front thereof and an incision portion 23 formed by cutting at least a part of a bottom of the door mounting surface 22.

The detergent supply apparatus 100C includes the detergent box 40C provided to accommodate a detergent, a housing 31C in which the detergent box 40C is detachably installed, and a popup unit 50C provided to allow the detergent box 40C to pop up or pass through from the housing 31C.

The detergent box 40C is provided with a detergent cover 41C on a top end thereof, and the detergent cover 41C may be formed to correspond to the incision portion 23 formed in the door guide 20.

Here, the detergent cover 41C may be formed to have the same material and color as the door guide 20 not to spoil a design.

The detergent in the detergent box 40C may be pumped by a pump unit 32C disposed outside the detergent supply apparatus 100C to be supplied into the drum 14.

For this, the pump unit 32C may include a first connection pipe 33C provided to be connected to the detergent box 40C and a second connection pipe 34C provided to be connected to the tub 13.

Accordingly, the detergent stored in the detergent box 40C may be pumped by the pump unit 32C as a necessary amount for one-time washing and supplied into the tub 13 through the first connection pipe 33C and the second connection pipe 34C during washing.

Here, the pump unit 32C may include a first pump 32Ca connected to a first accommodating portion 43C of the detergent box 40C and a second pump 32Cb connected to a second accommodating portion 45C, which will be described below.

In the embodiment, it has been shown as an example that the pump unit 32C is directly connected to the tub 13 by the second connection pipe 34C. However, the concept of the present disclosure is not limited thereto. For example, although not shown in the drawings, a water supply valve connected to an external water supply source may be installed above the tub 13 to supply washing water to an inside of the tub 13 and the second connection pipe 34C of the pump unit 32C may be connected to the water supply valve to supply the detergent together with the washing water to the tub 13.

Figure 21:
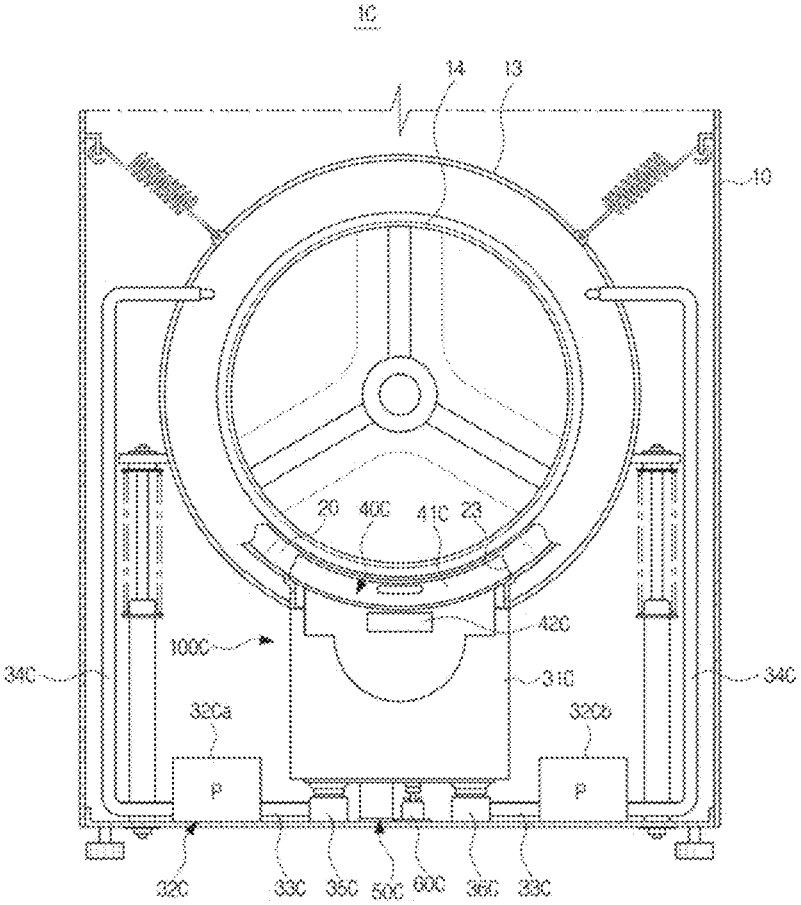
FIG. 21 is a schematic front view of a washing machine in which the detergent supply apparatus is mounted in accordance with still another embodiment of the present disclosure.
Figure 22:
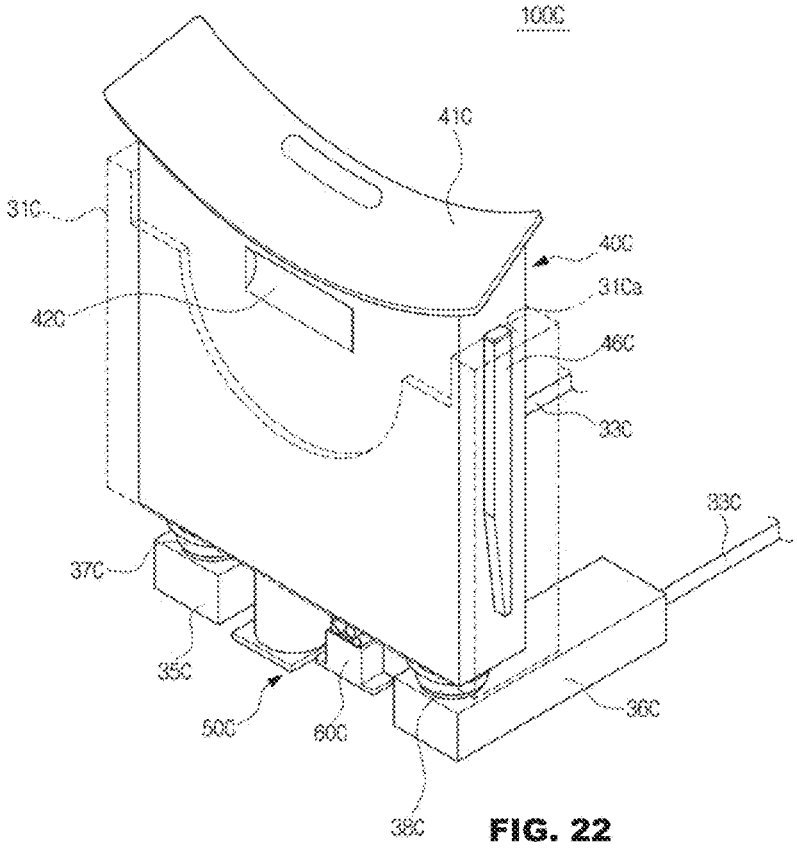
FIG. 22 is a schematic perspective view of a detergent supply apparatus in accordance with still another embodiment of the present disclosure.
Figure 23:
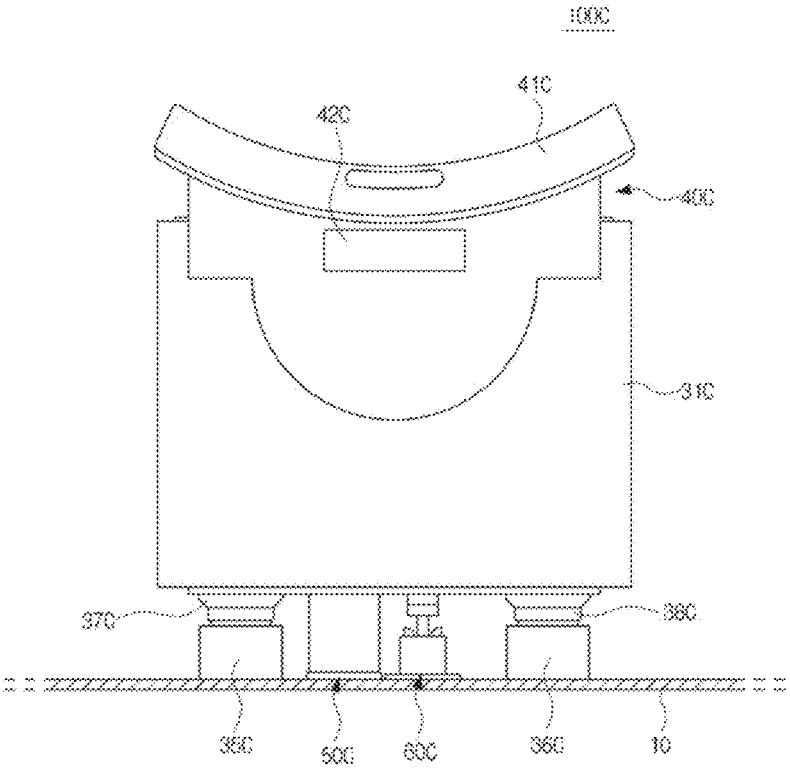
FIG. 23 is a schematic front view of the detergent supply apparatus in accordance with still another embodiment of the present disclosure.

As shown in FIGS. 21 to 23, the detergent supply apparatus 100C may include the housing 31C disposed inside the bottom of the front side 11 of the body 10, the detergent box 40C provided to pop up or pass through from inside the housing 31C and to be inserted or withdrawn, and the popup unit 50C provided to allow the detergent box 40C to pop up or pass through from the housing 31C.

The housing 31C may be disposed on the bottom inside the body 10 to allow the detergent box 40C to be moved up and down therein.

Guide grooves 31Ca for guiding a vertical movement of the detergent box 40C are formed on both inner surfaces of the housing 31C. Guide protrusions 46C corresponding to the guide grooves 31Ca protrude from both outer surfaces of the detergent box 40C.

An inside of the detergent box 40C is divided by a partition wall 44C. The first accommodating portion 43C for accommodating a liquid detergent may be formed on one side thereof and the second accommodating portion 45C for accommodating a fabric softener, etc. may be formed on another side.

The detergent box 40C may be formed with a first inlet 43Ca and a second inlet 45Ca for supplying the detergent and the fabric softener to the first accommodating portion 43C and the second accommodating portion 45C, respectively. Also, a first opening and closing portion 43Cb and a second opening and closing portion 45Cb for opening and closing the first inlet 43Ca and the second inlet 45Ca may be installed in the detergent box 40C, respectively.

A first ejection portion 47C includes a first ejection hole 47Ca formed on a bottom surface of the first accommodating portion 43C, and a second ejection portion 48C includes a second ejection hole 48Ca formed on a bottom surface of the second accommodating portion 45C.

The first ejection portion 47C and the second ejection portion 48C may be connected to a first connection portion 37C and a second connection portion 38C of the first reservoir 35C and second reservoir 36C provided on the bottom of the housing 31C.

The detergent box 40C stores about 30 time-amounts of the liquid detergent and the fabric softener, respectively. The first reservoir 35C and the second reservoir 36C may be provided to receive and store the detergent and the fabric softener necessary for one-time washing from the detergent box 40C.

The first reservoir 35C stores the detergent and the second reservoir 36C stores the fabric softener.

The first reservoir 35C may be connected to the first ejection portion 47C of the first accommodating portion 43C by a first connection portion 37C, and the second reservoir 36C may be connected to the second ejection portion 48C of the second accommodating portion 45C by a second connection portion 38C.

The first reservoir 35C and the second reservoir 36C may be connected to the pump unit 32C through the first connection pipe 33C, respectively.

Accordingly, during washing, the pump unit 32C uses the detergent and the fabric softener stored in the first reservoir 35C and the second reservoir 36C, respectively. The first reservoir 35C and the second reservoir 36C empty after washing are filled with the detergent and the fabric softener stored in the first accommodating portion 43C and the second accommodating portion 45C of the detergent box 40C.

In the embodiment, it has been shown as an example that the detergent and the fabric softener necessary for one-time washing are stored, pumped, and used by the first reservoir 35C and the second reservoir 36C. However, the concept of the present disclosure is not limited thereto. For example, valves are applied instead of the first reservoir 35C and the second reservoir 36C and supply amounts of the detergent and the fabric softener may be controlled through controlling of the valves and the pump unit.

Figure 24:
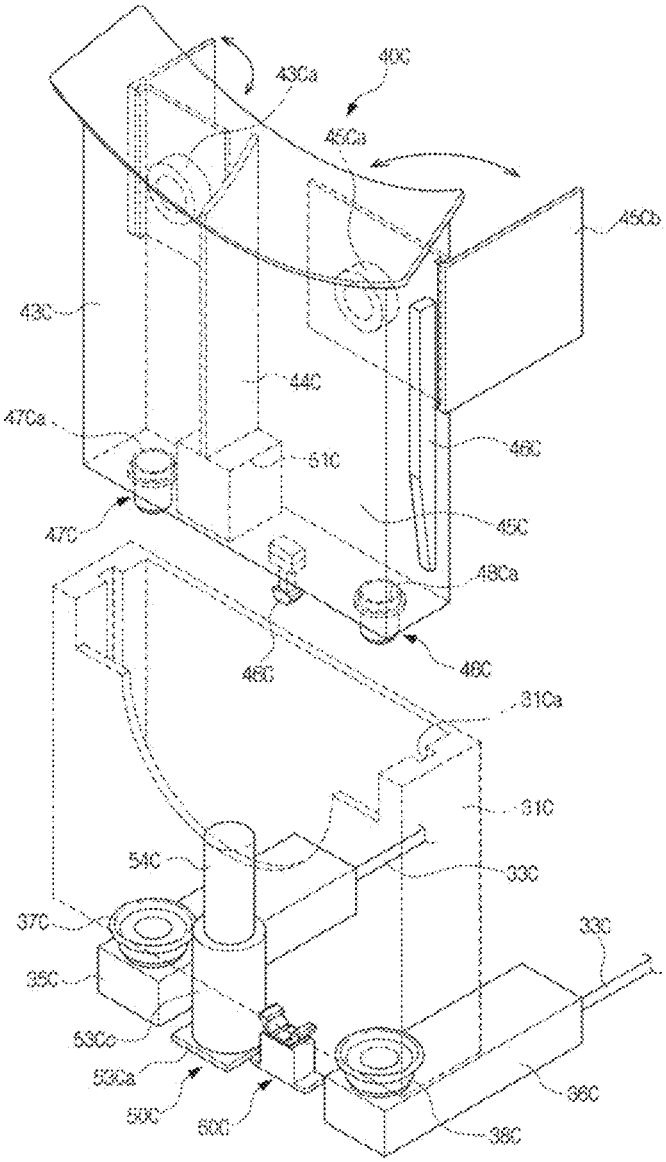
FIG. 24 is a schematic perspective view illustrating the detergent supply apparatus and a detergent box in accordance with still another embodiment of the present disclosure.
Figure 25:
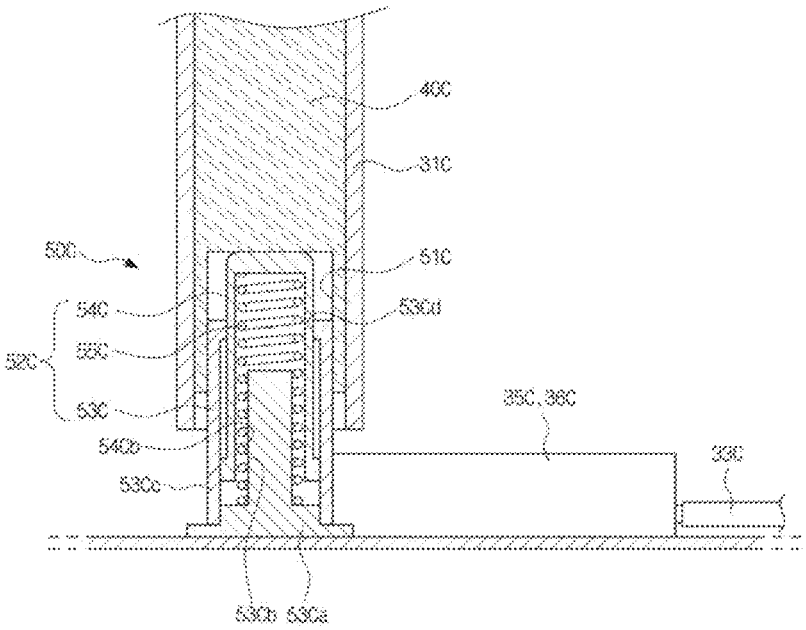
FIG. 25 is a schematic cross-sectional view of a popup unit of the detergent supply apparatus in accordance with still another embodiment of the present disclosure.

As shown in FIGS. 24 and 25, the detergent supply apparatus 100C includes the popup unit 50C provided to allow the detergent box 40C to pop up or pass through from the housing 31C to be inserted or withdrawn.

The popup unit 50C may include a popup supporting groove 51C formed to be dented inward on the bottom surface of the detergent box 40C and a popup member 52C elastically deformed to be coupled with the popup supporting groove 51C.

The popup member 52C may include a first popup portion 53C coupled with the bottom surface of the body 10, a second popup portion provided to be movable from an inside to an outside of the first popup portion 53C, and a popup spring 55C which elastically supports a space between the first popup portion 53C and the second popup portion 54C.

The first popup portion 53C includes a first supporting portion 53Ca provided to be coupled with and fixed to the bottom surface of the body 10, a popup guide protrusion 53Cb which protrudes upward from a center of the first supporting portion 53Ca to allow the popup spring 55C to be mounted on an outer surface thereof, and a second supporting portion 53Cc which is coupled with the first supporting portion 53Ca and has an outer surface thereof coupled with the popup supporting groove 51C of the detergent box 40C to allow the detergent box 40C to be stably moved.

A popup hole 53Cd is formed in a top surface of the second supporting portion 53Cc to allow the second popup portion 54C to be moved up and down. The second popup portion 54C is formed with a popup spring supporting groove 54Cb to support the popup spring 55C of the first popup portion 53C, and a stopper 54Ca which protrudes outward is formed on an outer end thereof not to be separated from the popup hole 53Cd of the second supporting portion 53Cc.

Accordingly, the second popup portion 54C may be elastically supported by the popup spring 55C to be elastically supported in a vertical direction with respect to the first popup portion 53C, thereby elastically supporting the detergent box 40C in a vertical direction with respect to the housing 31C.

Also, the popup unit 50C further includes a latch unit 60C to lock or unlock the detergent box 40C while the detergent box 40C moves in the vertical direction with respect to the housing 31C.

The detergent box 40C is provided to be vertically movable by the popup unit 50C using a push-and-push method. Here, when the detergent box 40C is pushed in a state of being locked by the latch unit 60C, the lock may be released and the detergent box 40C may be locked when the detergent box 40C is pushed in a state in which the lock is released.

The latch unit 60C includes a holding protrusion 61C which protrudes from a bottom surface of the housing 31C and a latch 70C provided to hold or release the holding protrusion 61C.

The latch 70C is provided on a fixing portion 63C provided to be fixed to the bottom surface of the body 10. The latch unit 60C of the popup unit 50C in accordance with the embodiment of the present disclosure will be described with reference to FIG. 7.

The holding protrusion 61C has a head portion 61Ca which widely spread in a mushroom shape. The head portion 61Caa may be inserted into the latch 70C.

The latch 70C may include a latch housing 71C fixed to an inside of the fixing portion 63C, a slide member 72C which moves forward and backward in the latch housing 71C, a spring 78C which elastically supports the slide member 72C, a guide groove 75C provided on the slide member 72C, a guide bar 77C with a fixing end 74Ca hinge-coupled with the latch housing 71C and a moving end 74Cb inserted into the guide groove 75C to guide or restrict a forward and backward movement of the slide member 72C, and a catch member 73C provided on an end of the slide member 72C to be elastically deformed to hold or release the holding protrusion 61C.

Figure 26:
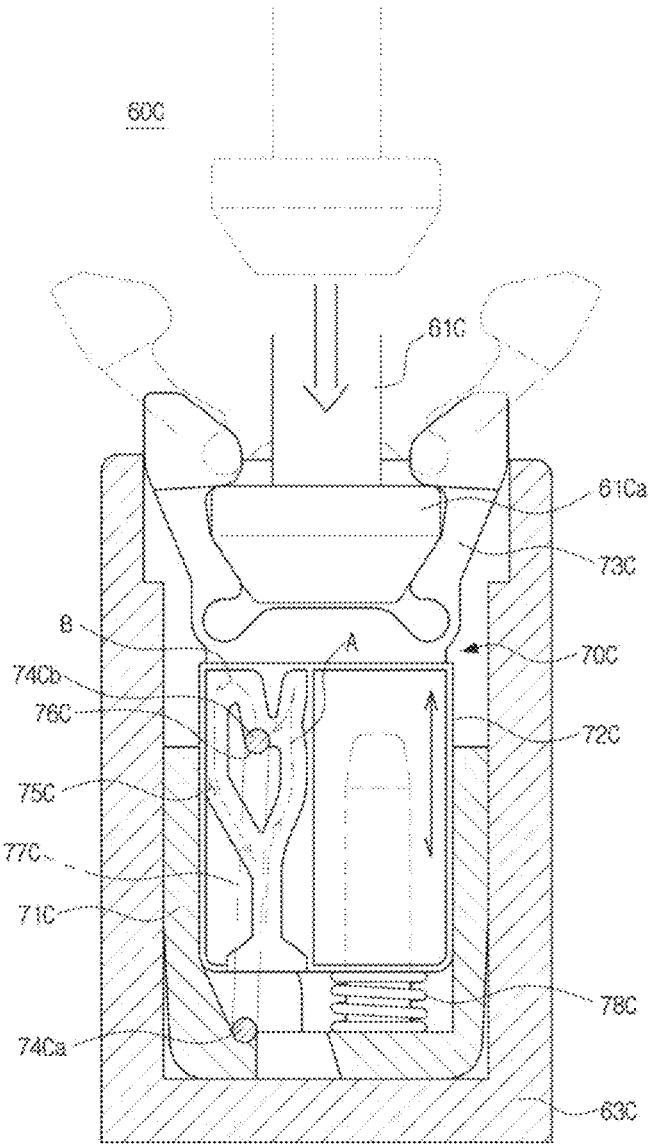
FIG. 26 is a schematic cross-sectional view of a latch unit of the detergent supply apparatus in accordance with still another embodiment of the present disclosure.

As shown in FIG. 26, when the detergent box 40C is pushed downward and the holding protrusion 61C moves downward, the holding protrusion 61C is allowed to push the slide member 72C downward.

The slide member 72C overcomes an elastic force of the spring 78C and moves downward. Here, the moving end 74Cb of the guide bar 77C moves along the guide groove 75C in a direction of a dotted line A.

As a result, the moving end 74Cb of the guide bar 77C is supported by a supporting surface 76C of the guide groove 75C, thereby stopping the movement of the slide member 72C. Here, the catch member 73C is elastically deformed to be retracted to catch the holding protrusion 61C, thereby fixing the detergent box 40C.

In this state, when the detergent box 40C is pressurized downward by the user, the moving end 74Cb of the guide bar 77C moves along the guide groove 75C in a direction of a solid line and the catch member 73C is restored to an original shape in such a way that the holding protrusion 61C caught by the catch member 73C is released and fixing of the detergent box 40C is released and allowed to move upward by the popup unit 50C.

Meanwhile, the detergent cover 41C of the detergent box 40C may be formed with a push portion 41Ca to allow the user to easily push. Also, a handle portion 42C may be formed on a side of the detergent box 40C to allow the user to easily withdraw or mount the detergent box 40C which moves upward from or in the housing 31C, that is, a detergent supply apparatus installation opening 23C.

Figure 27:
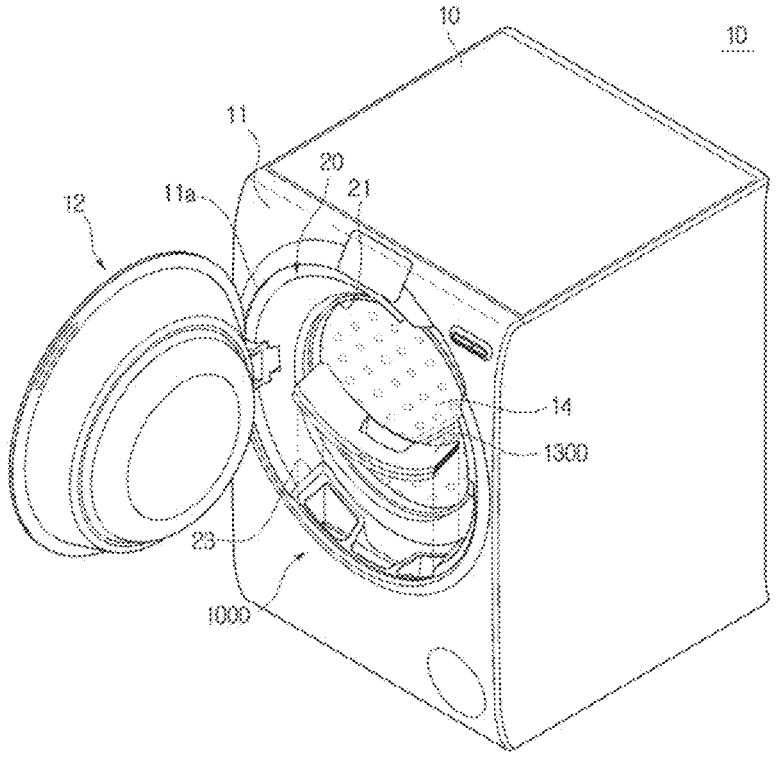
FIG. 27 is a schematic diagram of a washing machine in which a detergent box of a detergent supply apparatus is mounted in accordance with still another embodiment of the present disclosure.
Figure 28:
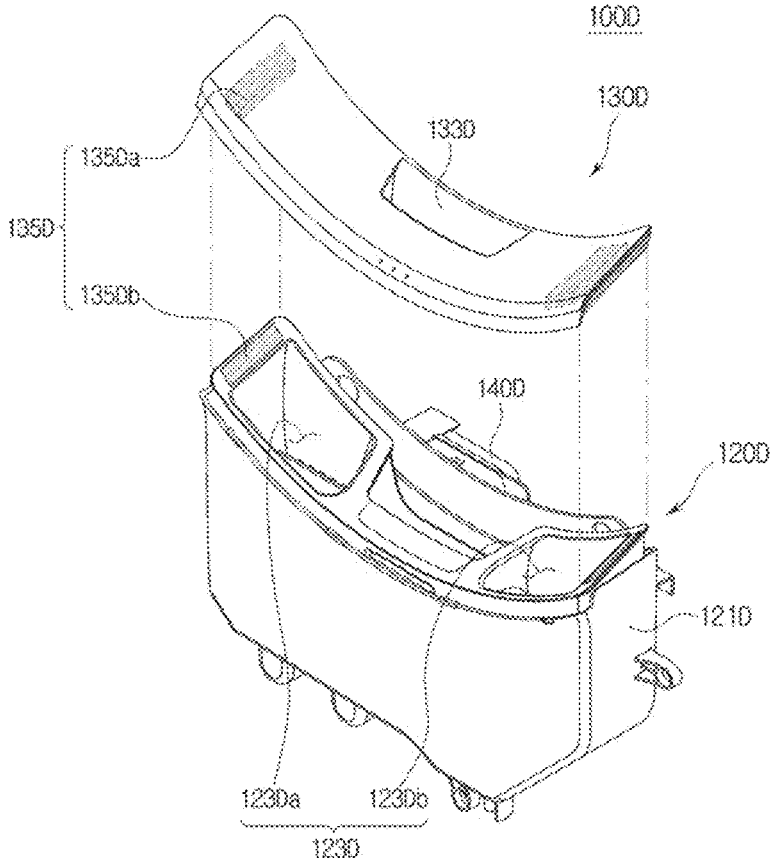
FIG. 28 is a schematic perspective view illustrating the detergent box of the detergent supply apparatus and a detergent box cover in accordance with still another embodiment of the present disclosure.

FIGS. 27 and 28 are schematic diagrams of a washing machine 1D in which a detergent supply apparatus 100D is mounted in accordance with still another embodiment of the present disclosure.

As shown in FIGS. 27 and 28, a detergent box 120D of the detergent supply apparatus 100D in accordance with still another embodiment of the present disclosure may be provided to be separable from the door guide 20 as necessary.

The door guide 20 is provided on the opening portion 11*a* formed in the front side 11 of the body 10, and the circular opening 21 is formed in the center thereof.

The door guide 20 may include the door mounting surface 22 formed to correspond to the second door frame 12*b* of the door 12 and the incision portion 23 formed by cutting at least the part of the bottom of the door mounting surface 22.

The incision portion 23 is provided to allow a detergent box cover 130D of the detergent supply apparatus 100D which will be described below to be detachably coupled therewith.

The detergent supply apparatus 100D may include the detergent box 120D and a detergent supply pump 140D provided to discharge a detergent and a fabric softener of the detergent box 120D.

The detergent box 120D includes a detergent box body 121D formed with a plurality of accommodating portions (not shown) to accommodate the detergent and the fabric softener therein. On a top surface of the detergent box body 121D, detergent inlets 123D are formed to supply the detergent and the fabric softener through the plurality of accommodating portions.

The detergent inlets 123D may include a first detergent inlet 123Da formed to insert the detergent and a second detergent inlet 123Db separated from the first detergent inlet 123Da and formed to insert the fabric softener.

A detergent box cover 130D may be separably coupled with a top end of the detergent box 120D to open and close the detergent inlets 123D.

The detergent box cover 130D may include magnets 135D provided to be detachable from the detergent box 120D.

The magnets 135D may include a first magnet 135Da disposed on the detergent box cover 130D and a second magnet 135Db disposed on the detergent box 120D to correspond to the first magnet 135Da.

Accordingly, due to magnetic properties of the first magnet 135Da and the second magnet 135Db, the detergent box cover 130D may be easily attached to or detached from the detergent box 120D.

As described above, when the detergent box cover 130D is separated from the detergent box 120D, since the detergent inlets 123D are exposed outward, the detergent and fabric softener may be replenished without separation of the detergent box 120D, thereby increasing convenience.

In the embodiment, it has been described as an example that the magnets 135D are disposed on top ends of both the detergent box cover 130D and the detergent box 120D, respectively. However, the concept of the present disclosure is not limited thereto. For example, the magnets may be disposed on the incision portion of the door guide provided to allow the detergent box cover to be mounted.

Meanwhile, the detergent box cover 130D is formed corresponding to the size of the incision portion 23 of the door guide 20. Here, the detergent box cover 130D may be formed to have the same material and color as those of the door guide 20 to improve an aesthetic aspect.

In the embodiment, it has been described as an example that the detergent box 120D is provided to be selectively separable from the incision portion 23 of the door guide 20 of the body 10 when the detergent box cover 130D is completely separated from the detergent box 120D. However, the concept of the present disclosure is not limited thereto. For example, it may be applied to the detergent supply apparatus provided to allow the detergent box to be separated and detachable from the body in accordance with one embodiment of the present disclosure.

Meanwhile, a repetitive description of the same components as those in accordance with one embodiment of the present disclosure will be omitted.

Figure 29:
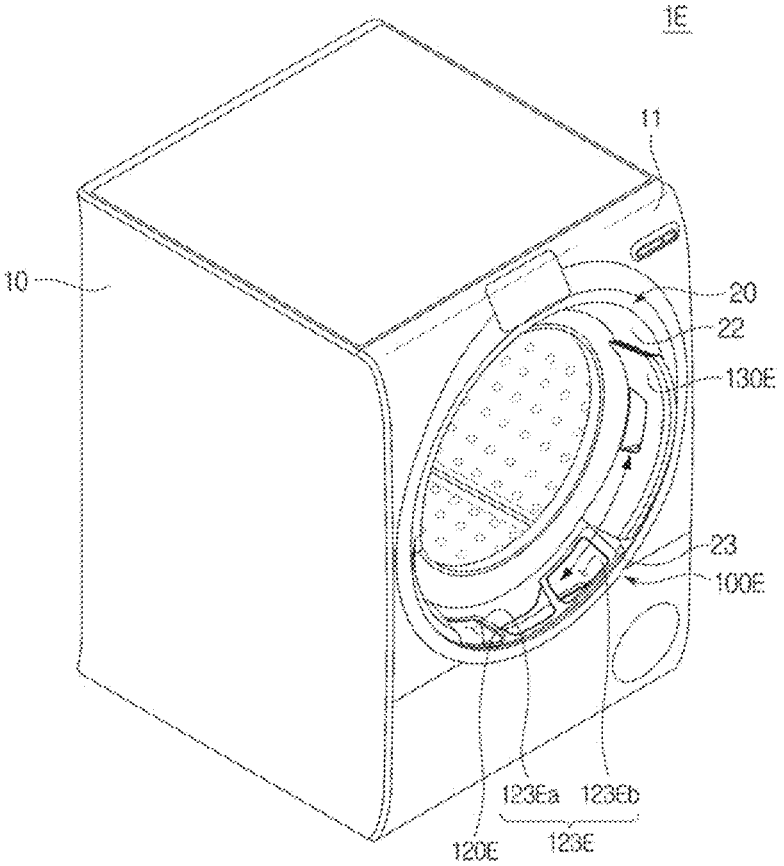
FIG. 29 is a schematic perspective view of a washing machine in which the detergent box of the detergent supply apparatus and a detergent box cover are mounted in accordance with still another embodiment of the present disclosure.

FIG. 29 is a schematic diagram of a washing machine 1E in which a detergent supply apparatus 100E is mounted in accordance with a further embodiment of the present disclosure.

As shown in FIG. 29, a detergent box 120E of the detergent supply apparatus 100E may be provided to be separable from the door guide 20 of the washing machine 1E as necessary.

The door guide 20 may be provided on the opening portion 11*a* formed in the front side 11 of the body 10. The door guide 20 may be formed with the circular opening 21 in the center thereof and may include the door mounting surface 22 in front thereof formed to correspond to the second door frame 12*b* of the door 12 and the incision portion 23 formed by cutting at least the part of the bottom of the door mounting surface 22.

The detergent box 120E provided in the incision portion 23 may be formed with respective accommodating portions (not shown) provided to accommodate a detergent and a fabric softener therein and may be provided with, a first detergent inlet 123Ea formed to be connected to the accommodating portion to insert the detergent, and a second detergent inlet 123Eb spaced at a certain interval from the first detergent inlet 123Ea and formed to insert the fabric softener on a top end thereof.

In the embodiment, it has been described as an example that detergent inlets 123E of the detergent box 120E are formed in such a way that respective inlets are formed in one detergent box to accommodate the detergent and the fabric softener. However, the concept of the present disclosure is not limited thereto. For example, the detergent box inlets may be provided to accommodate a detergent and a fabric softener.

Meanwhile, a detergent box cover 130E may be separably coupled with the top end of the detergent box 120E to open and close the detergent inlets 135E.

The detergent box cover 130E provided on the top end of the detergent box 120E may be provided to be slidable in a circumferential direction of the door guide 20.

Here, a guide rail (not shown) may be formed on the door mounting surface 22 of the door guide 20 to allow the detergent box cover 130E to be slidable.

Accordingly, the detergent box cover 130E is allowed to slide in the circumferential direction of the door guide 20 to expose the detergent inlets 123E on the top end of the detergent box 120E to allow the user to supply the detergent and the fabric softener, thereby increasing convenience.

A description of the same components as those in accordance with one embodiment of the present disclosure will be omitted.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a tub arranged within a body of the washing machine and adapted to store water;

a circulation pump to circulate water in and out of the tub;

a circulation path to connect the circulation pump and the tub to circulate the water by an operation of the circulation pump, the circulation path comprising a first water path extending between the tub and an inlet of the circulation pump, and a second water path extending between the tub and an outlet of the circulation pump;

a washing product supply apparatus comprising a washing product container to store the washing product having a first accommodating portion adapted for storing a first washing product and a second accommodating portion adapted for storing a second washing product, a washing product supply pump connected to the washing product container, and having a first outlet coupled to discharge the stored first washing product contained in the first accommodating portion, and a second outlet coupled to discharge the stored second washing product contained in the second accommodating portion, a washing product supply path comprising a first washing product supply pipe connected to the first outlet and a second washing product supply pipe connected to the second outlet, wherein the first washing product supply pipe and the second washing product supply pipe are connected to the first water path of the circulation path to supply the first washing product and the second washing product to the tub therethrough, respectively, so that when the washing product supply pump operates, at least one of the stored first washing product and the stored second washing product is discharged from the washing product container to the first water path via the first and second washing product supply pipes, respectively.

2. The washing machine of claim 1, further comprising a drainage apparatus to forcibly discharge water stored in the tub outside the body, and wherein the tub is connected with the drainage apparatus via the first water path and is connected with the circulating pump via the second water path.

3. The washing machine of claim 1, wherein the washing product supply pump further comprises:

a first chamber provided to receive the first washing product from the first accommodating portion, and a second chamber provided to receive the second washing product from the second accommodating portion, and wherein the first chamber is coupled to the first outlet and the second chamber is coupled to the second outlet.

4. The washing machine of claim 3, wherein the washing product supply pump further comprises:

a first piston member provided in the first chamber to apply a pressure to an inside of the first chamber to discharge the stored first washing product in the first chamber to the first outlet, and a second piston member provided in the second chamber to apply a pressure to an inside of the second chamber to discharge the stored second washing product in the second chamber to the second outlet.

5. The washing machine of claim 4, wherein the washing product supply pump further comprises:

a first motor connected to the first piston member to drive the first piston, and a second motor connected to the second piston member to drive the second piston.

6. The washing machine of claim 5, wherein the first piston member is provided to move up and down in the first chamber to control the pressure inside the first chamber by interlocking with the first motor, and the second piston member is provided to move up and down in the second chamber to control the pressure inside the second chamber by interlocking with the second motor.

7. The washing machine of claim 5, wherein the washing product supply pump further comprises:

a first gear member which connects the first motor and the first piston member, and a second gear member which connects the second motor and the second piston member.

8. The washing machine of claim 1, wherein:

the washing product container further includes a housing, and the first accommodating portion and the second accommodating portion are spaced apart and disposed inside the housing.

9. The washing machine of claim 3, wherein the first washing product is a detergent, and the second washing product is a softener.

10. The washing machine of claim 9, wherein the first washing product supply pipe is provided to supply the stored detergent in the first chamber to the first water path.

11. The washing machine of claim 9, wherein the second washing product supply pipe is provided to supply the stored softener in the second chamber to the first water path.

12. The washing machine of claim 1, further comprising a controller which is adapted such that during a washing operation, the first washing product stored in the first accommodating portion is moved by the washing product supply pump to the first water path through the first outlet and the first washing product supply pipe.

13. The washing machine of claim 12, wherein the controller is adapted such that during a washing operation, only the first washing product in the first water path moves together with the water discharged from the tub to the circulating pump and is supplied to the tub through the second water path.

14. The washing machine of any of claim 12, wherein the controller is adapted such that during a rinsing operation, when water is supplied to the tub, only the second washing product stored in the second accommodating portion is moved by the washing product supply pump to the first water path through the second outlet of the washing product supply pump and the second washing product supply pipe.

15. The washing machine of claim 14, wherein the controller is adapted such that during a rinsing operation, the second washing product in the first water path moves together with the water discharged from the tub to the circulating pump and moves into the tub through the second water path.

16. The washing machine of claim 3, wherein the washing product supply pump further comprises a sensor adapted for measuring whether the first washing product and the second washing product are present in at least one of the first and second chambers, respectively.

17. A washing machine comprising:

a tub arranged within a body of the washing machine and adapted to store water;

a circulation pump to circulate water in and out of the tub;

a circulation path to connect the circulation pump and the tub to circulate the water by an operation of the circulation pump; and a detergent supply apparatus comprising:

a detergent container to store the detergent having a first accommodating portion adapted for storing a detergent and a second accommodating portion adapted for storing a softener, a detergent supply pump connected to the detergent container, and having a first outlet coupled to discharge the stored detergent contained in the first accommodating portion, and a second outlet coupled to discharge the stored softener contained in the second accommodating portion, and a detergent supply path comprising a first supply pipe connected to the first outlet and a second supply pipe connected to the second outlet, wherein the first supply pipe and the second supply pipe are connected to the circulation path to supply the stored detergent and softener to the tub therethrough, respectively, so that when the detergent supply pump operates, at least one of the stored detergent and the stored softener is discharged from the detergent container to the circulation path via the first and second supply pipes.

18. The washing machine of claim 17, wherein the washing product supply pump further comprising:

a first chamber provided to receive the detergent from the first accommodating portion, and a second chamber provided to receive the softener from the second accommodating portion, and wherein the first chamber is connected to the first outlet and the second chamber is connected to the second outlet, respectively.

19. The washing machine of claim 18, wherein:

the first washing product supply pipe is provided to supply the stored detergent in the first chamber to the circulation path, and the second washing product supply pipe is provided to supply the stored softener in the second chamber to the circulation path.

20. A washing machine comprising:

a tub arranged within a body of the washing machine and adapted to store water;

a circulation pump to circulate water in and out of the tub;

a circulation path to connect the circulation pump and the tub to circulate the water by an operation of the circulation pump, the circulation path comprising a first water path extending between the tub and an inlet of the circulation pump, and a second water path extending between the tub and an outlet of the circulation pump;

a washing product supply apparatus comprising a washing product container including a detergent accommodating portion adapted for storing a detergent and a softener accommodating portion adapted for storing a softener, a washing product supply pump connected to the washing product container, and having a first outlet coupled to discharge the detergent from the detergent accommodating portion, and a second outlet coupled to discharge the softener from the softener accommodating portion, a washing product supply path comprising a detergent supply pipe connected to the first outlet and a softener supply pipe connected to the second outlet, wherein the detergent supply pipe and the softener supply pipe are respectively connected to the first water path to supply the detergent and the softener to the tub, respectively.

21. The washing machine of claim 20 wherein the washing product supply pump further comprises:

a first chamber provided to receive the detergent from the detergent accommodating portion, and a second chamber provided to receive the softener from the softener accommodating portion, and wherein the first chamber is connected to the first outlet and the second chamber is connected to the second outlet.

22. The washing machine of claim 21 wherein the washing product supply pump further comprises:

a first piston member provided in the first chamber to apply a pressure to an inside of the first chamber to discharge the stored detergent in the first chamber to the first outlet, and a second piston member provided in the second chamber to apply a pressure to an inside of the second chamber to discharge the stored softener in the second chamber to the second outlet.

23. The washing machine of claim 22 wherein the washing product supply pump further comprises:

a first motor connected to the first piston member to drive the first piston, and a second motor connected to the second piston member to drive the second piston.

24. The washing machine of claim 23, wherein the first piston member is provided to move up and down in the first chamber to control the pressure inside the first chamber by interlocking with the first motor, and the second piston member is provided to move up and down in the second chamber to control the pressure inside the second chamber by interlocking with the second motor.

25. The washing machine of claim 23, wherein the washing product supply pump further comprises:

a first gear member which connects the first motor and the first piston member, and a second gear member which connects the second motor and the second piston member.

* * * * *